US007189318B2

(12) United States Patent
Wilson et al.

(10) Patent No.: US 7,189,318 B2
(45) Date of Patent: Mar. 13, 2007

(54) TUNING ELECTRODES USED IN A REACTOR FOR ELECTROCHEMICALLY PROCESSING A MICROELECTRONIC WORKPIECE

(75) Inventors: Gregory J. Wilson, Kalispell, MT (US); Paul R. McHugh, Kalispell, MT (US); Robert A. Weaver, Whitefish, MT (US); Thomas L. Ritzdorf, Bigfork, MT (US)

(73) Assignee: Semitool, Inc., Kalispell, MT (US)

( * ) Notice: Subject to any disclaimer, the term of this patent is extended or adjusted under 35 U.S.C. 154(b) by 461 days.

(21) Appl. No.: 09/866,391

(22) Filed: May 24, 2001

(65) Prior Publication Data

US 2002/0139678 A1 Oct. 3, 2002

Related U.S. Application Data

(63) Continuation-in-part of application No. 09/849,505, filed on May 4, 2001, now Pat. No. 7,020,537, which is a continuation-in-part of application No. PCT/US00/10120, filed on Apr. 13, 2000.

(60) Provisional application No. 60/206,663, filed on May 24, 2000, provisional application No. 60/182,160, filed on Feb. 14, 2000, provisional application No. 60/143,769, filed on Jul. 12, 1999, provisional application No. 60/129,055, filed on Apr. 13, 1999.

(51) Int. Cl.

| | |
|---|---|
| ***B01J 10/00*** | (2006.01) |
| ***G05B 21/00*** | (2006.01) |
| ***G05B 15/00*** | (2006.01) |
| ***G05D 11/00*** | (2006.01) |
| ***G05D 7/00*** | (2006.01) |

(52) U.S. Cl. ..... 205/82; 205/80; 205/81; 205/83; 205/84; 205/102; 205/687; 205/775; 700/1; 700/28; 700/266; 700/283; 422/105; 422/109; 422/110; 422/129; 422/292

(58) Field of Classification Search ..... 700/266, 700/283, 28, 1; 422/129, 292, 105, 109, 422/110; 205/80, 81, 82, 83, 84, 102, 687, 205/775

See application file for complete search history.

(56) References Cited

U.S. PATENT DOCUMENTS

| | | | | |
|---|---|---|---|---|
| 1,526,644 | A | | 2/1925 | Pinney |
| 1,881,713 | A | | 10/1932 | Laukel |
| 2,256,274 | A | | 9/1941 | Boedecker et al. |
| 3,309,263 | A | | 3/1967 | Grobe |
| 3,616,284 | A | | 10/1971 | Bodmer et al. |
| 3,664,933 | A | | 5/1972 | Clauss |
| 3,706,635 | A | | 12/1972 | Kowalski |
| 3,706,651 | A | | 12/1972 | Leland |
| 3,716,462 | A | | 2/1973 | Jensen |
| 3,798,003 | A | | 3/1974 | Ensley et al. |
| 3,878,066 | A | | 4/1975 | Dettke et al. |
| 3,880,725 | A | * | 4/1975 | Van Raalte et al. ..... 205/95 |
| 3,930,963 | A | | 1/1976 | Polichette et al. |
| 3,968,885 | A | | 7/1976 | Hassan et al. |
| 4,000,046 | A | | 12/1976 | Weaver |
| 4,022,679 | A | | 5/1977 | Koziol et al. |
| 4,030,015 | A | | 6/1977 | Herko et al. |
| 4,046,105 | A | | 9/1977 | Gomez |
| 4,072,557 | A | | 2/1978 | Schiel |
| 4,082,638 | A | | 4/1978 | Jumer |
| 4,113,577 | A | | 9/1978 | Ross et al. |
| 4,134,802 | A | | 1/1979 | Herr |
| 4,137,867 | A | | 2/1979 | Aigo |
| 4,165,252 | A | | 8/1979 | Gibbs |
| 4,170,959 | A | | 10/1979 | Aigo |
| 4,222,834 | A | | 9/1980 | Bacon et al. |
| 4,238,310 | A | | 12/1980 | Eckler et al. |
| 4,246,088 | A | | 1/1981 | Murphy et al. |
| 4,259,166 | A | | 3/1981 | Whitehurst |
| 4,287,029 | A | | 9/1981 | Shimamura |
| 4,304,641 | A | | 12/1981 | Grandia et al. |
| 4,323,433 | A | | 4/1982 | Loch |
| 4,341,629 | A | | 7/1982 | Uhlinger |
| 4,360,410 | A | | 11/1982 | Fletcher et al. |

4,378,283 A 3/1983 Seyffert
4,384,930 A 5/1983 Eckles
4,391,694 A 7/1983 Runsten
4,422,915 A 12/1983 Wielonski et al.
4,431,361 A 2/1984 Bayne
4,437,943 A 3/1984 Beck et al.
4,440,597 A 4/1984 Wells et al.
4,443,117 A 4/1984 Muramoto et al.
4,449,885 A 5/1984 Hertel et al.
4,451,197 A 5/1984 Lange
4,463,503 A 8/1984 Applegate
4,466,864 A 8/1984 Bacon
4,469,566 A 9/1984 Wray
4,475,823 A 10/1984 Stone
4,480,028 A 10/1984 Kato et al.
4,495,153 A 1/1985 Midorikawa
4,495,453 A 1/1985 Inaba
4,500,394 A 2/1985 Rizzo
4,529,480 A 7/1985 Trokhan
4,541,895 A 9/1985 Albert
4,566,847 A 1/1986 Maeda et al.
4,576,685 A 3/1986 Goffredo et al.
4,576,689 A 3/1986 Makkaev
4,585,539 A 4/1986 Edson
4,604,177 A 8/1986 Sivilotti
4,604,178 A 8/1986 Fiegener
4,634,503 A 1/1987 Nogavich
4,639,028 A 1/1987 Olson
4,648,944 A 3/1987 George et al.
4,670,126 A 6/1987 Messer et al.
4,685,414 A 8/1987 DiRico
4,687,552 A 8/1987 Early et al.
4,693,017 A 9/1987 Oehler et al.
4,696,729 A 9/1987 Santini
4,715,934 A 12/1987 Tamminen
4,741,624 A 5/1988 Barroyer
4,760,671 A 8/1988 Ward
4,761,214 A 8/1988 Hinman
4,770,590 A 9/1988 Hugues et al.
4,781,800 A 11/1988 Goldman
4,800,818 A 1/1989 Kawaguchi et al.
4,814,197 A * 3/1989 Duffy et al. ..... 427/8
4,828,654 A 5/1989 Reed
4,849,054 A 7/1989 Klowak
4,858,539 A 8/1989 Schumann
4,864,239 A 9/1989 Casarcia et al.
4,868,992 A 9/1989 Crafts et al.
4,898,647 A 2/1990 Luce et al.
4,902,398 A 2/1990 Homstad
4,906,341 A 3/1990 Yamakawa
4,913,085 A 4/1990 Vohringer et al.
4,924,890 A 5/1990 Giles et al.
4,944,650 A 7/1990 Matsumoto
4,949,671 A 8/1990 Davis et al.
4,951,601 A 8/1990 Maydan et al.
4,959,278 A 9/1990 Shimauchi
4,962,726 A 10/1990 Matsushita et al.
4,979,464 A 12/1990 Kunze-Concewitz et al.
4,988,533 A 1/1991 Freeman et al.
5,000,827 A 3/1991 Schuster
5,024,746 A 6/1991 Stierman et al.
5,026,239 A 6/1991 Chiba
5,048,589 A 9/1991 Cook et al.
5,054,988 A 10/1991 Shiraiwa
5,055,036 A 10/1991 Asano et al.
5,061,144 A 10/1991 Akimoto
5,069,548 A 12/1991 Boehnlein
5,078,852 A 1/1992 Yee
5,083,364 A 1/1992 Olbrich et al.
5,096,550 A 3/1992 Mayer
5,110,248 A 5/1992 Asano et al.
5,115,430 A 5/1992 Hahne
5,125,784 A 6/1992 Asano
5,128,912 A 7/1992 Hug et al.
5,135,636 A 8/1992 Yee et al.
5,138,973 A 8/1992 Davis et al.
5,146,136 A 9/1992 Ogura
5,151,168 A 9/1992 Gilton
5,155,336 A 10/1992 Gronet et al.
5,156,174 A 10/1992 Thompson
5,156,730 A 10/1992 Bhatt
5,168,886 A 12/1992 Thompson et al.
5,168,887 A 12/1992 Thompson et al.
5,169,408 A 12/1992 Biggerstaff et al.
5,172,803 A 12/1992 Lewin
5,174,045 A 12/1992 Thompson et al.
5,178,512 A 1/1993 Skrobak
5,178,639 A 1/1993 Nishi
5,180,273 A 1/1993 Sakaya et al.
5,183,377 A 2/1993 Becker et al.
5,186,594 A 2/1993 Toshima et al.
5,209,817 A 5/1993 Ahmad
5,217,586 A 6/1993 Datta
5,222,310 A 6/1993 Thompson
5,227,041 A 7/1993 Brogden
5,228,232 A 7/1993 Miles
5,228,966 A 7/1993 Murata
5,230,371 A 7/1993 Lee
5,232,511 A 8/1993 Bergman
5,235,995 A 8/1993 Bergman et al.
5,238,500 A 8/1993 Bergman
5,252,137 A 10/1993 Tateyama et al.
5,252,807 A 10/1993 Chizinsky
5,256,262 A 10/1993 Blomsterberg
5,256,274 A 10/1993 Poris
5,271,953 A 12/1993 Litteral
5,271,972 A 12/1993 Kwok et al.
5,301,700 A 4/1994 Kamikawa et al.
5,302,464 A 4/1994 Nomura
5,306,895 A 4/1994 Ushikoshi et al.
5,314,294 A 5/1994 Taniguchi
5,316,642 A 5/1994 Young
5,326,455 A 7/1994 Kubo et al.
5,330,604 A 7/1994 Allum et al.
5,332,271 A 7/1994 Grant et al.
5,332,445 A 7/1994 Bergman
5,340,456 A 8/1994 Mehler
5,344,491 A 9/1994 Katou
5,348,620 A 9/1994 Hermans et al.
5,364,504 A 11/1994 Smurkoski et al.
5,366,785 A 11/1994 Sawdai
5,366,786 A 11/1994 Connor et al.
5,368,711 A 11/1994 Poris
5,368,715 A 11/1994 Hurley et al.
5,372,848 A 12/1994 Blackwell
5,376,176 A 12/1994 Kuriyama
5,377,708 A 1/1995 Bergman et al.
5,388,945 A 2/1995 Garric et al.
5,391,285 A 2/1995 Lytle
5,391,517 A 2/1995 Gelatos et al.
5,405,518 A 4/1995 Hsieh et al.
5,411,076 A 5/1995 Matsunaga et al.
5,421,987 A 6/1995 Tzanavaras et al.
5,427,674 A 6/1995 Langenskiold et al.
5,429,686 A 7/1995 Chiu et al.
5,429,733 A 7/1995 Ishida
5,431,803 A 7/1995 DiFranco et al.
5,437,777 A 8/1995 Kishi
5,441,629 A 8/1995 Kosaki
5,442,416 A 8/1995 Tateyama et al.
5,443,707 A 8/1995 Mori
5,445,484 A 8/1995 Kato et al.
5,447,615 A 9/1995 Ishida
5,454,405 A 10/1995 Hawes
5,460,478 A 10/1995 Akimoto et al.
5,464,313 A 11/1995 Ohsawa 5,472,502 A 12/1995 Batchelder
5,489,341 A 2/1996 Bergman et al.
5,500,081 A 3/1996 Bergman
5,501,768 A 3/1996 Hermans et al.
5,508,095 A 4/1996 Allum et al.
5,512,319 A 4/1996 Cook et al.
5,514,258 A 5/1996 Brinket et al.
5,516,412 A 5/1996 Andricacos et al.
5,522,975 A 6/1996 Andricacos et al.
5,527,390 A 6/1996 Ono et al.
5,544,421 A 8/1996 Thompson et al.
5,549,808 A 8/1996 Farooq
5,567,267 A 10/1996 Kazama et al.
5,571,325 A 11/1996 Ueyama
5,575,611 A 11/1996 Thompson et al.
5,584,310 A 12/1996 Bergman
5,584,971 A 12/1996 Komino
5,593,545 A 1/1997 Rugowski et al.
5,597,460 A 1/1997 Reynolds
5,597,836 A 1/1997 Hackler et al.
5,600,532 A 2/1997 Michiya et al.
5,609,239 A 3/1997 Schlecker
5,620,581 A 4/1997 Ang
5,639,206 A 6/1997 Oda et al.
5,639,316 A 6/1997 Cabral
5,641,613 A 6/1997 Boff et al.
5,650,082 A 7/1997 Anderson
5,651,823 A 7/1997 Parodi et al.
5,658,387 A 8/1997 Reardon
5,660,472 A 8/1997 Peuse et al.
5,660,517 A 8/1997 Thompson et al.
5,662,788 A 9/1997 Sandhu
5,664,337 A 9/1997 Davis et al.
5,670,034 A 9/1997 Lowery
5,676,337 A 10/1997 Giras et al.
5,677,118 A 10/1997 Spara et al.
5,678,320 A 10/1997 Thompson et al.
5,681,392 A 10/1997 Swain
5,683,564 A 11/1997 Reynolds
5,684,654 A 11/1997 Searle et al.
5,684,713 A 11/1997 Asada et al.
5,700,127 A 12/1997 Harada et al.
5,711,646 A 1/1998 Ueda et al.
5,723,028 A 3/1998 Poris
5,731,678 A 3/1998 Zila et al.
5,744,019 A 4/1998 Ang
5,746,565 A 5/1998 Tepolt
5,747,098 A 5/1998 Larson
5,754,842 A 5/1998 Minagawa
5,755,948 A 5/1998 Lazaro et al.
5,759,006 A 6/1998 Miyamoto et al.
5,762,751 A 6/1998 Bleck
5,765,444 A 6/1998 Bacchi
5,765,889 A 6/1998 Nam et al.
5,776,327 A 7/1998 Botts et al.
5,785,826 A 7/1998 Greenspan
5,788,829 A 8/1998 Joshi et al.
5,802,856 A 9/1998 Schaper et al.
5,829,791 A 11/1998 Kotsubo et al.
5,843,296 A 12/1998 Greenspan
5,871,626 A 2/1999 Crafts
5,871,805 A * 2/1999 Lemelson ..... 427/8
5,882,498 A 3/1999 Dubin
5,892,207 A 4/1999 Kawamura et al.
5,904,827 A 5/1999 Reynolds
5,908,543 A 6/1999 Matsunami
5,925,227 A 7/1999 Kobayashi et al.
5,932,077 A 8/1999 Reynolds
5,937,142 A 8/1999 Moslehi et al.
5,957,836 A 9/1999 Johnson
5,980,706 A 11/1999 Bleck
5,985,126 A 11/1999 Bleck
5,989,397 A 11/1999 Laube et al.
5,989,406 A 11/1999 Beetz
5,998,123 A 12/1999 Tanaka et al.
5,999,886 A 12/1999 Martin et al.
6,001,235 A 12/1999 Arken et al.
6,004,828 A 12/1999 Hanson
6,017,820 A 1/2000 Ting et al.
6,027,631 A 2/2000 Broadbent
6,028,986 A 2/2000 Song
6,053,687 A 4/2000 Kirkpatrick
6,072,160 A 6/2000 Bahl
6,072,163 A 6/2000 Armstrong et al.
6,074,544 A 6/2000 Reid
6,080,288 A 6/2000 Schwartz et al.
6,080,291 A 6/2000 Woodruff et al.
6,080,691 A 6/2000 Lindsay et al.
6,086,680 A 7/2000 Foster et al.
6,090,260 A 7/2000 Inoue
6,091,498 A 7/2000 Hanson
6,099,702 A 8/2000 Reid
6,099,712 A 8/2000 Ritzdorf
6,103,085 A 8/2000 Woo et al.
6,107,192 A 8/2000 Subrahmanyan et al.
6,108,937 A 8/2000 Raaijmakers
6,110,011 A 8/2000 Somekh
6,110,345 A 8/2000 Iacoponi
6,110,346 A 8/2000 Reid
6,130,415 A 10/2000 Knoot
6,136,163 A 10/2000 Cheung
6,139,703 A 10/2000 Hanson et al.
6,139,712 A 10/2000 Patton
6,140,234 A 10/2000 Uzoh et al.
6,143,147 A 11/2000 Jelinek
6,143,155 A 11/2000 Adams
6,151,532 A 11/2000 Barone et al.
6,156,167 A 12/2000 Patton
6,157,106 A 12/2000 Tietz et al.
6,159,354 A 12/2000 Contolini
6,162,344 A 12/2000 Reid
6,162,488 A 12/2000 Gevelber et al.
6,168,693 B1 * 1/2001 Uzoh et al. ..... 204/229.4
6,168,695 B1 1/2001 Woodruff
6,174,425 B1 1/2001 Simpson
6,174,796 B1 1/2001 Takagi et al.
6,179,983 B1 1/2001 Reid
6,184,068 B1 2/2001 Ohtani et al.
6,193,859 B1 2/2001 Contolini
6,199,301 B1 3/2001 Wallace
6,228,232 B1 5/2001 Woodruff
6,234,738 B1 5/2001 Kimata
6,258,220 B1 7/2001 Dordi
6,261,433 B1 7/2001 Landau
6,270,647 B1 8/2001 Graham
6,277,263 B1 8/2001 Chen
6,318,951 B1 11/2001 Schmidt
6,322,112 B1 11/2001 Duncan
6,322,677 B1 11/2001 Woodruff
6,342,137 B1 1/2002 Woodruff
6,391,166 B1 5/2002 Wang
6,402,923 B1 6/2002 Mayer
6,444,101 B1 9/2002 Stevens
6,491,806 B1 12/2002 Dubin
6,497,801 B1 12/2002 Woodruff
6,562,421 B2 5/2003 Sudo
6,599,412 B1 7/2003 Graham
6,623,609 B2 9/2003 Harris
6,632,334 B2 10/2003 Anderson
6,709,562 B1 * 3/2004 Andricacos et al. ..... 205/122
6,755,954 B2 6/2004 Mayer et al.
6,773,571 B1 8/2004 Mayer
2001/0024611 A1 9/2001 Woodruff
2001/0032788 A1 10/2001 Woodruff
2001/0043856 A1 11/2001 Woodruff
2002/0008036 A1 1/2002 Wang

| | | | |
|---|---|---|---|
| 2002/0008037 | A1 | 1/2002 | Wilson |
| 2002/0032499 | A1 | 3/2002 | Wilson |
| 2002/0046952 | A1 | 4/2002 | Graham |
| 2002/0079215 | A1 | 6/2002 | Wilson et al. |
| 2002/0096508 | A1 | 7/2002 | Weaver et al. |
| 2002/0125141 | A1 | 9/2002 | Wilson |
| 2002/0139678 | A1 | 10/2002 | Wilson |
| 2003/0038035 | A1 | 2/2003 | Wilson |
| 2003/0062258 | A1 | 4/2003 | Woodruff |
| 2003/0070918 | A1 | 4/2003 | Hanson |
| 2003/0127337 | A1 | 7/2003 | Hanson |
| 2004/0031693 | A1 | 2/2004 | Chen |
| 2004/0055877 | A1 | 3/2004 | Wilson |
| 2004/0099533 | A1 | 5/2004 | Wilson |

FOREIGN PATENT DOCUMENTS

| | | | |
|---|---|---|---|
| CA | 873651 | | 6/1971 |
| DE | 195 25 666 | | 10/1996 |
| EP | 0 140 404 | A1 | 8/1984 |
| EP | 0047132 | B1 | 7/1985 |
| EP | 0 677 612 | A3 | 10/1985 |
| EP | 0 257 670 | | 3/1988 |
| EP | 0 290 210 | | 11/1988 |
| EP | 0290210 | | 11/1988 |
| EP | 0 677 612 | A2 | 10/1995 |
| EP | 0582019 | B1 | 10/1995 |
| EP | 0544311 | B1 | 5/1996 |
| EP | 0 881 673 | A2 | 5/1998 |
| EP | 0 982 771 | A1 | 8/1999 |
| EP | 1 069 213 | A2 | 7/2000 |
| EP | 0452939 | B1 | 11/2000 |
| GB | 2217107 | A | 3/1989 |
| GB | 2 254 288 | A | 3/1992 |
| GB | 41 14 427 | | 11/1992 |
| GB | 2 279 372 | A | 6/1994 |
| JP | 1048442 | | 2/1989 |
| JP | 4144150 | | 5/1992 |
| JP | 4311591 | | 11/1992 |
| JP | 5146984 | | 6/1993 |
| JP | 5195183 | A | 8/1993 |
| JP | 5211224 | | 8/1993 |
| JP | 6017291 | A | 1/1994 |
| JP | 6073598 | A | 3/1994 |
| JP | 6224202 | A | 8/1994 |
| JP | 7113159 | A | 5/1995 |
| JP | 7197299 | A | 8/1995 |
| JP | 10-083960 | | 3/1998 |
| JP | 11036096 | A | 2/1999 |
| JP | 11080993 | A | 3/1999 |
| WO | WO-90/00476 | | 1/1990 |
| WO | WO-91/04213 | | 4/1991 |
| WO | WO-95/06326 | | 3/1995 |
| WO | WO-95/20064 | | 7/1995 |
| WO | WO-99/16936 | | 4/1996 |
| WO | WO-99/15710 | | 4/1999 |
| WO | WO-99/25904 | | 5/1999 |
| WO | WO-99/25905 | | 5/1999 |
| WO | WO-99/40615 | | 8/1999 |
| WO | WO-99/41434 | | 8/1999 |
| WO | WO-99/45567 | | 9/1999 |
| WO | WO-99/45745 | | 9/1999 |
| WO | WO-00/02675 | | 1/2000 |
| WO | WO-00/02808 | | 1/2000 |
| WO | WO-00/02808 | A1 | 1/2000 |
| WO | WO-00/03072 | | 1/2000 |
| WO | WO-02/02808 | | 1/2000 |
| WO | WO-00/32835 | | 6/2000 |
| WO | WO-00/61498 | | 10/2000 |
| WO | WO-00/61837 | | 10/2000 |
| WO | WO-01/46910 | | 6/2001 |
| WO | WO-01/90434 | | 11/2001 |
| WO | WO-01/91163 | | 11/2001 |
| WO | WO-02/17203 | | 2/2002 |
| WO | WO-02/045476 | | 6/2002 |
| WO | WO-03/18874 | | 9/2002 |
| WO | WO-02/097165 | | 12/2002 |
| WO | WO-02/97165 | | 12/2002 |
| WO | WO-02/099165 | | 12/2002 |
| WO | WO-02/99165 | | 12/2002 |

OTHER PUBLICATIONS

Ritter et al., "Two- and Three- Dimensional Numberical Modeling of Copper Electroplating For Advanced ULSI Metallization", E-MRS Conference, Symposium M, *Basic Models to Enhance Reliability*; Strasbourg (France), 1999.
U.S. Appl. No. 08/940,524, filed Sep. 30, 1997, Bleck et al.
U.S. Appl. No. 08/990,107, filed Dec. 15, 1997, Hanson et al.
U.S. Appl. No. 09/114,105, filed Jul. 11, 1998, Woodruff et al.
U.S. Appl. No. 09/618,707, filed Jul. 18, 2000, Hanson et al.
U.S. Appl. No. 09/679,928, filed Jul. 18, 2000, Woodruff et al.
U.S. Appl. No. 10/729,349, filed Dec. 5, 2003 Klocke.
U.S. Appl. No. 10/729,357, filed Dec. 5, 2003, Klocke.
U.S. Appl. No. 10/817,659, filed Apr. 2, 2004, Wilson et al.
U.S. Appl. No. 60/129,055, filed Apr. 13, 1999, McHugh.
U.S. Appl. No. 60/143,769, filed Jul. 12, 1999, McHugh.
U.S. Appl. No. 60/182,160, filed Feb. 14, 2000, McHugh et al.
U.S. Appl. No. 60/206,663, filed May 24, 2000, Wilson et al.
U.S. Appl. No. 60/294,690, filed May 30, 2001, Gibbons et al.
U.S. Appl. No. 60/316,597, filed Aug. 31, 2001, Hanson.
U.S. Appl. No. 60/607,046, filed Sep. 3, 2004, Klocke.
U.S. Appl. No. 60/607,460, filed Sep. 3, 2004, Klocke.
Contolini et al., "Copper Electroplating Process for Sub-Half-Micron ULSI Structures," VMIC Conference 1995 ISMIC—04/95/0322, pp. 322-328, Jun. 17-29, 1995.
Devaraj et al., "Pulsed Electrodeposition of Copper," Plating & Surface Finishing, pp. 72-78, Aug. 1992.
Dubin, "Copper Plating Techniques for ULSI Metallization," Advanced MicroDevices.
Dubin, V.M., "Electrochemical Deposition of Copper for On-Chip Interconnects," Advanced MicroDevices.
Gauvin et al., "The Effect of Chloride Ions on Copper Deposition," J. of Electrochemical Society, vol. 99, pp. 71-75, Feb. 1952.
Lee, Tien-Yu Tom et al., "Application of a CFD Tool in Designing a Fountain Plating Cell for Uniform Bump Plating of Semiconductor Wafers," IEEE Transactions on Components, Packaging and Manufacturing Technology, Feb. 1996, pp. 131-137, vol. 19, No. 1.
Lee, Tien-Yu Tom et al., "Application of a CFD Tool in Designing a Fountain Plating Cell for Uniform Bump Plating of Semiconductor Wafers," IEEE Transactions On Components, Packaging and Manufacturing Technology-13 Part B, Feb. 1996, pp. 131-137, vol. 19, No. 1, IEEE.
Lee, Tien-Yu Tom, "Application of a CFD Tool in Designing a Fountain Plating Cell for Uniform Bump Plating of Semiconductor Wafers," IEE Transactions on Components, Packaging, and Manufacturing Technology (Feb. 1996), vol. 19, No. 1, IEEE.
Lowenheim, Frederick A., "Electroplating," Jan. 1979, 12 pgs, McGraw-Hill Book Company, USA.
Lowenheim, Frederick A., "Electroplating Electrochemistry Applied to Electroplating," 1978, pp. 152-155, McGraw-Hill Book Company, New York.
Ossro, N.M., "An Overview of Pulse Plating," Plating and Surface Finishing, Mar. 1986.
Passal, F., "Copper Plating During the Last Fifty Years," Plating, pp. 628-638, Jun. 1959.
Patent Abstract of Japan, "Organic Compound and its Application," Publciation No. 08-003153, Publication Date: Jan. 9, 1996.
Patent Abstract of Japan, "Partial Plating Device," Publciation No. 01234590, Publication Date: Sep. 19, 1989.
Patent Abstract of Japan, "Plating Method" Publication No. 57171690, Publication Date: Oct. 22, 1982.
Patent Abstract of Japan, English Abstract Translation—Japanese Utility Model No. 2538705, Publication Date: Aug. 25, 1992.
PCT International Search Report for PCT/US02/17840, Applicant: Semitool, Inc., Mar. 2003, 5 pages.

Ritter et al., "Two- Three-Dimensional Numberical Modeling of Copper Electroplating For Advanced ULSI Metallization," E-MRS Conference Symposium M. Basic Models to Enhance Reliability, Strabourg (FRANCE) 1999.
Ritter, G., et al., "Two-And Three-Dimensional Numerical Modeling of Copper Electroplating for Advanced ULSI Metallization," Jun. 1999, 13 pgs, E-MRS Conference Symposium M. Basic Models to Enhance Reliability, Strasbourg, France.
Singer, P., "Copper Goes Mainstream: Low k to Follow," Semiconductor International, pp. 67-70, Nov. 1997.
International Search Report for PCT/US01/14509; Applicant: Semitool, Inc., dated Apr. 28, 2005; 6 pgs.

* cited by examiner

*Primary Examiner*—Brian Sines
(74) *Attorney, Agent, or Firm*—Perkins Coie LLP

(57) ABSTRACT

A facility for selecting and refining electrical parameters for processing a microelectronic workpiece in a processing chamber is described. The facility initially configures the electrical parameters in accordance with either a mathematical model of the processing chamber or experimental data derived from operating the actual processing chamber. After a workpiece is processed with the initial parameter configuration, the results are measured and a sensitivity matrix based upon the mathematical model of the processing chamber is used to select new parameters that correct for any deficiencies measured in the processing of the first workpiece. These parameters are then used in processing a second workpiece, which may be similarly measured, and the results used to further refine the parameters. In some embodiments, the facility analyzes a profile of the seed layer applied to a workpiece, and determines and communicates to a material deposition tool a set of control parameters designed to deposit material on the workpiece in a manner that compensates for deficiencies in the seed layer.

22 Claims, 7 Drawing Sheets

TUNING ELECTRODES USED IN A REACTOR FOR ELECTROCHEMICALLY PROCESSING A MICROELECTRONIC WORKPIECE

CROSS-REFERENCES TO RELATED APPLICATIONS

The present application is a continuation-in-part of U.S. patent application Ser. No. 09/849,505, filed May 4, 2001, now U.S. Pat. No. 7,020,537, which claims the benefit of U.S. Provisional Patent Application No. 60/206,663, filed May 24, 2000, and which is a continuation-in-part of International Patent Application No. PCT/US00/10120, filed Apr. 13, 2000, designating the United States and claiming the benefit of U.S. Provisional Patent Application No. 60/182,160, filed Feb. 14, 2000, No. 60/143,769, filed Jul. 12, 1999, and No. 60/129,055, filed Apr. 13, 1999; and this application claims the benefit of provisional application No. 60/206,663, filed May 24, 2000; the disclosures of each of which are hereby expressly incorporated by reference in their entireties.

FIELD OF THE INVENTION

The present invention is directed to the field of automatic process control, and, more particularly, to the field of controlling a material deposition process.

BACKGROUND OF THE INVENTION

The fabrication of microelectronic components from a microelectronic workpiece, such as a semiconductor wafer substrate, polymer substrate, etc., involves a substantial number of processes. For purposes of the present application, a microelectronic workpiece is defined to include a workpiece formed from a substrate upon which microelectronic circuits or components, data storage elements or layers, and/or micro-mechanical elements are formed. There are a number of different processing operations performed on the microelectronic workpiece to fabricate the microelectronic component(s). Such operations include, for example, material deposition, patterning, doping, chemical mechanical polishing, electropolishing, and heat treatment.

Material deposition processing involves depositing or otherwise forming thin layers of material on the surface of the microelectronic workpiece. Patterning provides selective deposition of a thin layer and/or removal of selected portions of these added layers. Doping of the semiconductor wafer, or similar microelectronic workpiece, is the process of adding impurities known as "dopants" to selected portions of the wafer to alter the electrical characteristics of the substrate material. Heat treatment of the microelectronic workpiece involves heating and/or cooling the workpiece to achieve specific process results. Chemical mechanical polishing involves the removal of material through a combined chemical/mechanical process while electropolishing involves the removal of material from a workpiece surface using electrochemical reactions.

Numerous processing devices, known as processing "tools," have been developed to implement one or more of the foregoing processing operations. These tools take on different configurations depending on the type of workpiece used in the fabrication process and the process or processes executed by the tool. One tool configuration, known as the LT-210C™ processing tool and available from Semitool, Inc., of Kalispell, Mont., includes a plurality of microelectronic workpiece processing stations that are serviced by one or more workpiece transfer robots. Several of the workpiece processing stations utilize a workpiece holder and a process bowl or container for implementing wet processing operations. Such wet processing operations include electroplating, etching, cleaning, electroless deposition, electropolishing, etc. In connection with the present invention, it is the electrochemical processing stations used in the LT-210C™ that are noteworthy. Such electrochemical processing stations perform the foregoing electroplating, electropolishing, anodization, etc., of the microelectronic workpiece. It will be recognized that the electrochemical processing system set forth herein is readily adapted to implement each of the foregoing electrochemical processes.

In accordance with one configuration of the LT-210C™ tool, the electrochemical processing stations include a workpiece holder and a process container that are disposed proximate one another. The workpiece holder and process container are operated to bring the microelectronic workpiece held by the workpiece holder into contact with an electrochemical processing fluid disposed in the process container. When the microelectronic workpiece is positioned in this manner, the workpiece holder and process container form a processing chamber that may be open, enclosed, or substantially enclosed.

Electroplating and other electrochemical processes have become important in the production of semiconductor integrated circuits and other microelectronic devices from microelectronic workpieces. For example, electroplating is often used in the formation of one or more metal layers on the workpiece. These metal layers are often used to electrically interconnect the various devices of the integrated circuit. Further, the structures formed from the metal layers may constitute microelectronic devices such as read/write heads, etc.

Electroplated metals typically include copper, nickel, gold, platinum, solder, nickel-iron, etc. Electroplating is generally effected by initial formation of a seed layer on the microelectronic workpiece in the form of a very thin layer of metal, whereby the surface of the microelectronic workpiece is rendered electrically conductive. This electro-conductivity permits subsequent formation of a blanket or patterned layer of the desired metal by electroplating. Subsequent processing, such as chemical mechanical planarization, may be used to remove unwanted portions of the patterned or metal blanket layer formed during electroplating, resulting in the formation of the desired metallized structure.

Electropolishing of metals at the surface of a workpiece involves the removal of at least some of the metal using an electrochemical process. The electrochemical process is effectively the reverse of the electroplating reaction and is often carried out using the same or similar reactors as electroplating.

Anodization typically involves oxidizing a thin-film layer at the surface of the workpiece. For example, it may be desirable to selectively oxidize certain portions of a metal layer, such as a Cu layer, to facilitate subsequent removal of the selected portions in a solution that etches the oxidized material faster than the non-oxidized material. Further, anodization may be used to deposit certain materials, such as perovskite materials, onto the surface of the workpiece.

As the size of various microelectronic circuits and components decreases, there is a corresponding decrease in the manufacturing tolerances that must be met by the manufacturing tools. In connection with the present invention as described below, electrochemical processes must uniformly process the surface of a given microelectronic workpiece.

Further, the electrochemical process must meet workpiece-to-workpiece uniformity requirements.

Electrochemical processes may be conducted in reaction chambers having either a single electrode or multiple electrodes. Where a single-electrode reaction chamber is used, improving the level uniformity achieved by the process often involves manual trial-and-error modifications to the hardware configuration of the reaction chamber. For example, operators of the process may experiment with repositioning or reorienting the electrode, the workpiece, or a baffle separating the electrode from the workpiece, or may modify aspects of a fluid flow within the reaction chamber in attempts to improve the level uniformity achieved by the process.

In a multiple-electrode reaction chamber, two or more electrodes are arranged in some pattern. Each of the electrodes is connected to an electrical power supply that provides the electrical power used to execute the electrochemical processing operations. Preferably, at least some of the electrodes are connected to different electrical nodes so that the electrical power provided to them by the power supply may be provided independent of the electrical power provided to other electrodes in the array.

Electrode arrays having a plurality of electrodes facilitate localized control of the electrical parameters used to electrochemically process the microelectronic workpiece. This localized control of the electrical parameters can be used to provide greater uniformity of the electrochemical processing across the surface of the microelectronic workpiece when compared to single electrode systems without necessitating hardware changes. However, determining the electrical parameters for each of the electrodes in the array to achieve the desired process uniformity can be problematic. Typically, the electrical parameter (i.e., electrical current, voltage, etc.) for a given electrode in a given electrochemical process is determined experimentally using a manual trial and error approach. Using such a manual trial and error approach, however, can be very time-consuming. Further, the electrical parameters do not easily translate to other electrochemical processes. For example, a given set of electrical parameters used to electroplate a metal to a thickness X onto the surface of a microelectronic workpiece cannot easily be used to derive the electrical parameters used to electroplate a metal to a thickness Y. Still further, the electrical parameters used to electroplate a desired film thickness X of a given metal (e.g., copper) are generally not suitable for use in electroplating another metal (e.g., platinum). Similar deficiencies in this trial and error approach are associated with other types of electrochemical processes (i.e., anodization, electropolishing, etc.). Also, this manual trial and error approach often must be repeated in several common circumstances, such as when the thickness or level of uniformity of the seed layer changes, when the target plating thickness or profile changes, or when the plating rate changes.

In view of the foregoing, a system for electrochemically processing a microelectronic workpiece that can be used to automatically identify electrical parameters that cause a multiple electrode array to achieve a high level of uniformity for a wide range of electrochemical processing variables (e.g., seed layer thicknesses, seed layer types, electroplating materials, etc.) would have significant utility.

SUMMARY

In the following, a facility for automatically identifying electrical parameters that produce a high level of uniformity in electrochemically processing a microelectronic workpiece is described. Embodiments of this facility are adapted to accommodate various electrochemical processes; reactor designs and conditions; plating materials and solutions; workpiece dimensions, materials, and conditions, and the nature and condition of existing coatings on the workpiece. Accordingly, use of the facility may typically result in substantial automation of electrochemical processing, even where a large number of variables in different dimensions are present. Such automation has the capacity to reduce the cost of skilled labor required to oversee a processing operation, as well as increase output quality and throughput. Additionally, use of the facility can both streamline and improve the process of designing new electroplating reactors.

In one exemplary embodiment, the facility selects and refines electrical parameters for processing a microelectronic workpiece in a processing chamber. The facility initially configures the electrical parameters in accordance with either a mathematical model of the processing chamber or experimental data derived from operating the actual processing chamber. After a workpiece is processed with the initial parameter configuration, the results are measured and a sensitivity matrix based upon the mathematical model of the processing chamber is used to select new parameters that correct for any deficiencies measured in the processing of the first workpiece. These parameters are then used in processing a second workpiece, which may be similarly measured, and the results used to further refine the parameters.

In another exemplary embodiment, the facility utilizes a sensitivity matrix data structure. The sensitivity matrix data structure relates to a deposition chamber for depositing material on a workpiece. The deposition chamber has a number of deposition initiators, associated with each of which is a control parameter. For example, the deposition chamber may have deposition initiators that are electrodes, whose control parameters are electrical current levels or other control parameters. The data structure contains a number of quantitative entries, each of which predicts, for a given change in the control parameter associated with a given deposition initiator, the expected change in deposited material thickness at a given radius. The contents of this data structure may be used to determine revised deposition initiator parameters for better conforming deposited material thicknesses to a target profile for deposited material thicknesses.

In another exemplary embodiment, the facility utilizes a material deposition process data structure, which contains a set of parameter values used in a material deposition process. These parameters have been generated by adjusting an earlier-used set of parameters to resolve differences between measurements of a workpiece deposited using the earlier-used set of parameters in a target deposition profile specified for the deposition process. The contents of this data structure may be used to deposit an additional workpiece in great conformance with the specified deposition profile.

In another exemplary embodiment, the facility controls an electroplating process having multiple steps, which is performed in an electroplating chamber having a number of electrodes. For each electrode, the facility determines the net plating charge delivered through the electrode during a first plating cycle to plate a first workpiece. This is accomplished by summing the plating charges delivered through the electrode in each step of the process. The facility then compares a plating profile achieved in plating the first workpiece to a target plating profile. In such comparison, the facility identifies deviations between the achieved plating profile and the target plating profile. The facility determines new net plating charges for each electrode selected to reduce the identified deviations in the second workpiece. For each of these new net plating charges, the facility distributes the new net plating charge across the steps of the process, and uses the distributed new net plating charges to determine a current for each electrode for each step of the process. A second plating cycle may then be conducted to plate a second workpiece using the currents determined for each electrode for each step.

In another exemplary embodiment, the facility evaluates a design for an electroplating reactor. The facility first applies a mathematical model embodying the reactor design to a set of initial electrode current to determine a first resulting plating profile. The facility compares the first resulting plating profile to a target plating profile to obtain a first difference. The facility then applies a sensitivity technique to identify a set of revised electrode currents, and applies the mathematical model to the set of revised electrode currents to determine a second resulting plating profile. The facility compares the second resulting plating profile to the target plating profile to obtain a second difference, and evaluates the design based on the obtained second difference.

In another exemplary embodiment, the facility is embodied in an apparatus for selecting parameters for use in controlling operation of a deposition chamber to deposit material on a selected wafer in a way that optimizes conformity with a specified deposition pattern. The apparatus includes a measurement receiving subsystem that receives the following measurements: pre-deposition thicknesses of the selected wafer before material is deposited on the wafer; post-deposition thicknesses of an already-deposited wafer after material is deposited on the already-deposited wafer; and pre-deposition thicknesses of the already-deposited wafer before material is deposited on the wafer. The apparatus further includes a parameter selection subsystem that selects the parameters to be used to deposit material on the selected wafer based on the specified deposition pattern, the pre-deposition thicknesses of the selected wafer, the pre-deposition thicknesses of the already-deposited wafer, parameters used for depositing material on the already-deposited wafer, and the post-deposition thicknesses of the already-deposited wafer.

In another exemplary embodiment, the facility electroplates a selected surface using a plurality of electrodes. The facility obtains a current specification set comprised of a plurality of current levels, each specified for a particular one of the plurality of electrodes. The current levels of the current specification set each represent a modification of current levels of a distinguished current specification set, modified in order to improve results produced by electroplating in accordance with the distinguished current specification set. For each electrode, the facility delivers the current level specified for the electrode by the current specification set to the electrode in order to electroplate the selected surface.

In another exemplary embodiment, the facility automatically configures parameters usable to control operation of a reaction chamber to electropolish a selected wafer in a way that optimizes conformity with a specified electropolishing pattern. The facility receives pre-polishing thicknesses of the selected wafer before the selected wafer is polished. The facility also receives post-polishing thicknesses of an already-polished wafer the already-polished wafer is polished. The facility further receives pre-polishing thicknesses of the already-polished wafer before the already-polished wafer is polished. The facility selects the parameters to polish the selected wafer based on the specified polishing pattern, the pre-polishing thicknesses of the selected wafer, the pre-polishing thicknesses of the already-polished wafer, parameters used for polishing the already-polished wafer, and the post-polishing thicknesses of the already-polished wafer.

In another exemplary embodiment, the facility electroplates a microelectronic workpiece. The facility receives data representing a profile of a seed layer that has been applied to the workpiece, such as from a metrology station. The facility identifies deficiencies in the seed layer based upon the profile of the seed layer represented by the received data, and determines a set of control parameters for plating the workpiece in a manner that compensates for the identified deficiencies in the seed layer. The facility communicates this determined set of control parameters to a plating tool for use in plating the workpiece.

DETAILED DESCRIPTION

Figure 1:
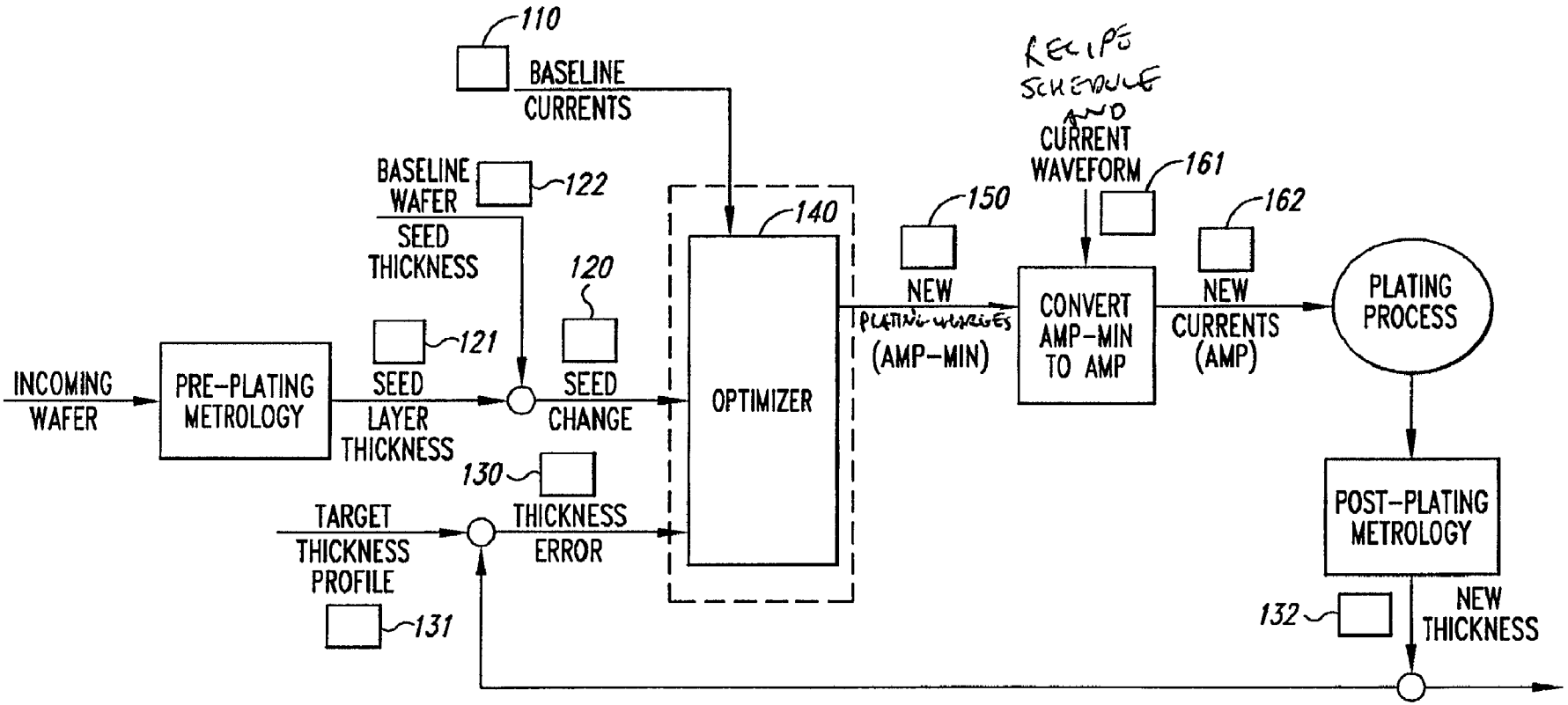
FIG. 1 is a process schematic diagram showing inputs and outputs of the optimizer.

A facility for automatically selecting and refining electrical parameters for processing a microelectronic workpiece ("the optimizer") is disclosed. In many embodiments, the optimizer determines process parameters affecting the processing of a round workpiece as a function of processing results at various radii on the workpiece. In some embodiments, the optimizer adjusts the electrode currents for a multiple electrode electroplating chamber, such as multiple anode reaction chambers of the Paragon tool provided by Semitool, Inc. of Kalispell, Mont., in order to achieve a specified thickness profile (i.e., flat, convex, concave, etc.) of a coating, such as a metal or other conductor, applied to a semiconductor wafer. The optimizer adjusts electrode currents for successive workpieces to compensate for changes in the thickness of the seed layer of the incoming workpiece (a source of feed forward control), and/or to correct for non-uniformities produced in prior wafers at the anode currents used to plate them (a source of feedback control). In this way, the optimizer is able to quickly achieve a high level of uniformity in the coating deposited on workpieces without substantial manual intervention.

The facility typically operates an electroplating chamber containing a principal fluid flow chamber, and a plurality of electrodes disposed in the principal fluid flow chamber. The electroplating chamber typically further contains a workpiece holder positioned to hold at least one surface of the microelectronic workpiece in contact with an electrochemical processing fluid in the principal fluid flow chamber, at least during electrochemical processing of the microelectronic workpiece. One or more electrical contacts are configured to contact the at least one surface of the microelectronic workpiece, and an electrical power supply is connected to the one or more electrical contacts and to the plurality of electrodes. At least two of the plurality of electrodes are independently connected to the electrical power supply to facilitate independent supply of power thereto. The apparatus also includes a control system that is connected to the electrical power supply to control at least one electrical power parameter respectively associated with each of the independently connected electrodes. The control system sets the at least one electrical power parameter for a given one of the independently connected electrodes based on one or more user input parameters and a plurality of predetermined sensitivity values; wherein the sensitivity values correspond to process perturbations resulting from perturbations of the electrical power parameter for the given one of the independently connected electrodes.

For example, although the present invention is described in the context of electrochemical processing of the microelectronic workpiece, the teachings herein can also be extended to other types of microelectronic workpiece processing. In effect, the teachings herein can be extended to other microelectronic workpiece processing systems that have individually controlled processing elements that are responsive to control parameters and that have interdependent effects on a physical characteristic of the microelectronic workpiece that is processed using the elements. Such systems may employ sensitivity tables or matrices as set forth herein and use them in calculations with one or more input parameters sets to arrive at control parameter values that accurately result in the targeted physical characteristic of the microelectronic workpiece.

FIG. 1 is a process schematic diagram showing inputs and outputs of the optimizer. FIG. 1 shows that the optimizer 140 uses up to three sources of input: baseline currents 110, seed change 120, and thickness error 130. The baseline currents 110 are the anode currents used to plate the previous wafer or another set of currents for which plating thickness results are known. For the first workpiece in a sequence of workpieces, the baseline currents used to plate the wafer are typically specified by a source other than the optimizer. For example, they may be specified by a recipe used to plate the wafers, or may be manually determined.

The seed change 120 is the difference between the thickness of the seed layer of the incoming wafer 121 and the thickness of the seed layer of the previous plated wafer 122. The seed change input 120 is said to be a source of feed-forward control in the optimizer, in that it incorporates information about the upcoming plating cycle, as it reflects the measurement the wafer to be plated in the upcoming plating cycle. Thickness error 130 is the difference in thickness between the previous plated wafer 132 and the target thickness profile 131 specified for the upcoming plating cycle. The thickness error 130 is said to be a source of feedback control, because it incorporates information from an earlier plating cycle, that is, the thickness of the wafer plated in the previous plating cycle.

FIG. 1 further shows that the optimizer outputs new plating charges 150 for each electrode in the upcoming plating cycle, expressed in amp-minute units. The new plating charges output is combined with a recipe schedule and a current waveform 161 to generate the currents 162, in amps, to be delivered through each electrode at each point in the recipe schedule. These new currents are used by the plating process to plate a wafer in the next plating cycle. In embodiments in which different types of power supplies are used, other types of control parameters are generated by the optimizer for use in operating the power supply. For example, where a voltage control power supply is used, the control parameters generated by the optimizer are voltages, expressed in volts. The wafer so plated is then subjected to post-plating metrology to measure its plated thickness 132.

While the optimizer is shown as receiving inputs and producing outputs at various points in the processing of these values, it will be understood by those in the art that the optimizer may be variously defined to include or exclude aspects of such processing. For example, while FIG. 1 shows the generation of seed change from baseline wafer seed thickness and seed layer thickness outside the optimizer, it is contemplated that such generation may alternatively be performed within the optimizer.

Figure 2:
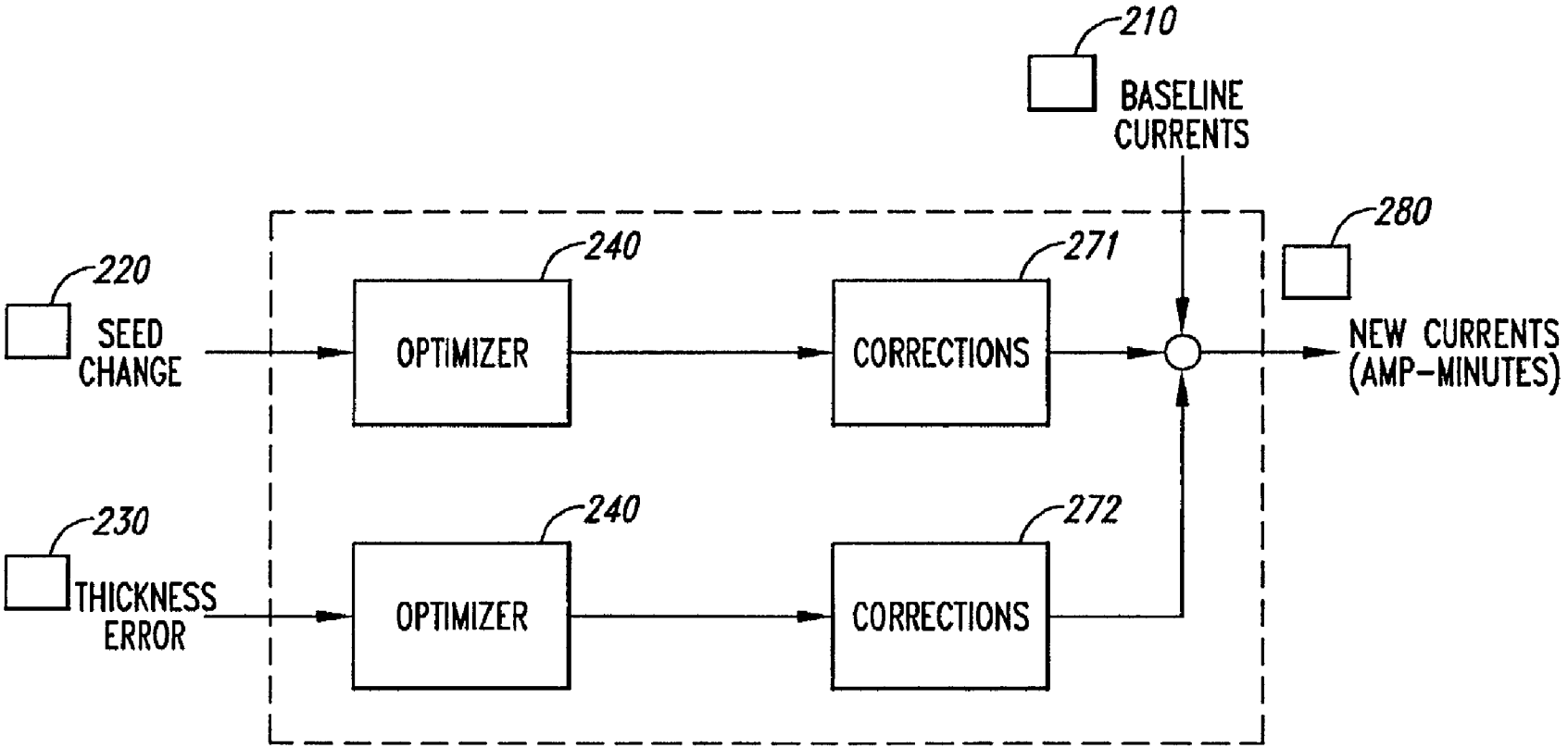
FIG. 2 is a process schematic diagram showing a branched correction system utilized by some embodiments of the optimizer.

FIG. 2 is a process schematic diagram showing a branched correction system utilized by some embodiments of the optimizer. The branched adjustment system utilizes two independently-engageable correction adjustments, a feedback adjustment (230, 240, 272) due to thickness errors and a feed forward adjustment (220, 240, 271) due to incoming seed layer thickness variation. When the anode currents produce an acceptable uniformity, the feedback loop may be disengaged from the transformation of baseline currents 210 to new currents 280. The feed forward compensation may be disengaged in situations where the seed layer variations are not expected to affect thickness uniformity. For example, after the first wafer of a similar batch is corrected for, the feed-forward compensation may be disengaged and the corrections may be applied to each sequential wafer in the batch.

Figure 3:
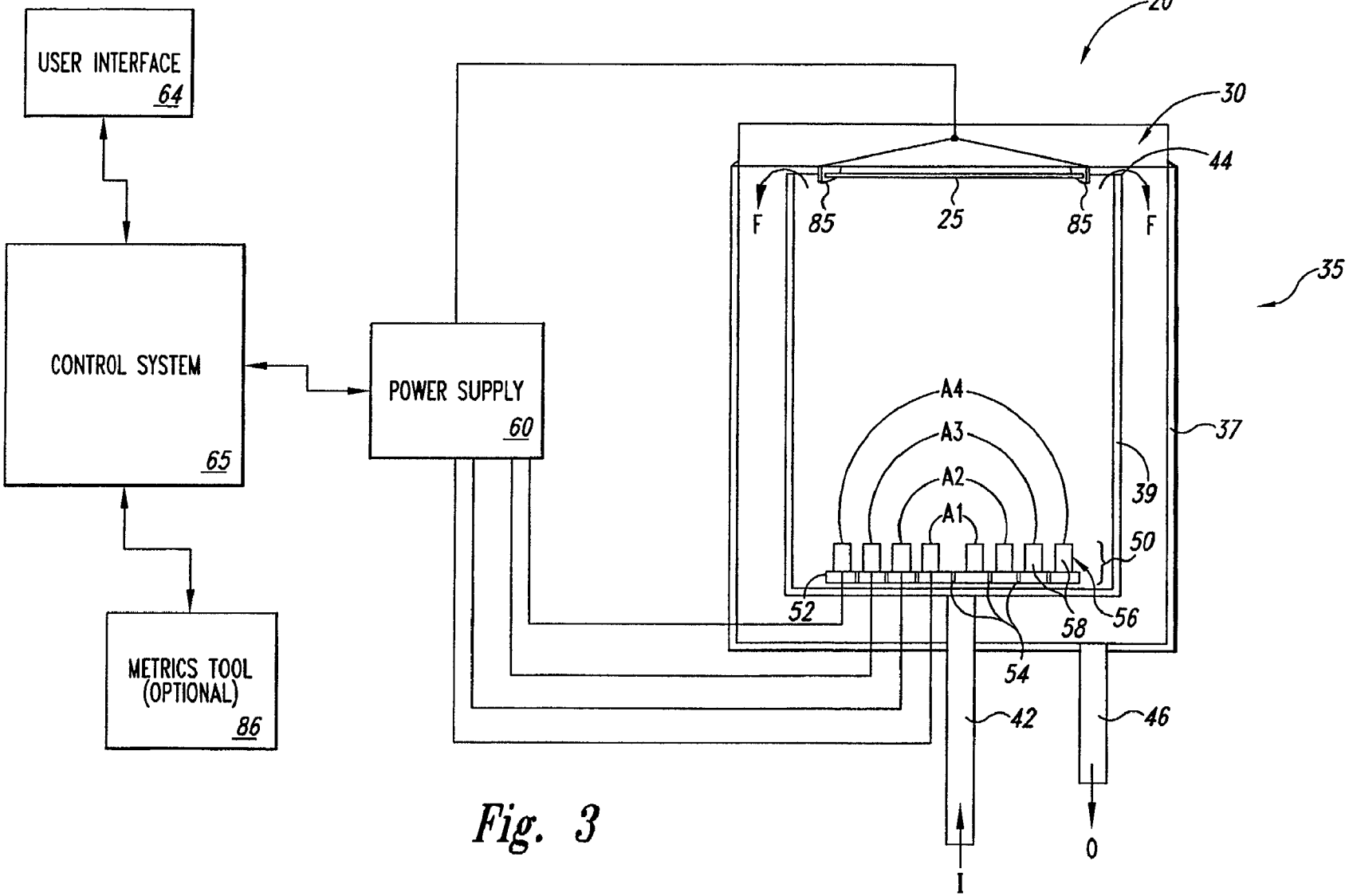
FIG. 3 is schematic block diagram of an electrochemical processing system constructed in accordance with one embodiment of the optimizer.

FIG. 3 is schematic block diagram of an electrochemical processing system constructed in accordance with one embodiment of the optimizer. FIG. 3 shows a reactor assembly 20 for electrochemically processing a microelectronic workpiece 25, such as a semiconductor wafer, that can be used in connection with the present invention. Generally stated, an embodiment of the reactor assembly 20 includes a reactor head 30 and a corresponding reactor base or container shown generally at 35. The reactor base 35 can be a bowl and cup assembly for containing a flow of an electrochemical processing solution. The reactor 20 of FIG. 3 can be used to implement a variety of electrochemical processing operations such as electroplating, electropolishing, anodization, etc., as well as to implement a wide variety of other material deposition techniques. For purposes of the following discussion, aspects of the specific embodiment set forth herein will be described, without limitation, in the context of an electroplating process.

The reactor head 30 of the reactor assembly 20 can include a stationary assembly (not shown) and a rotor assembly (not shown). The rotor assembly may be configured to receive and carry an associated microelectronic workpiece 25, position the microelectronic workpiece in a process-side down orientation within reactor container 35, and to rotate or spin the workpiece. The reactor head 30 can also include one or more contacts 85 (shown schematically) that provide electroplating power to the surface of the microelectronic workpiece. In the illustrated embodiment, the contacts 85 are configured to contact a seed layer or other conductive material that is to be plated on the plating surface microelectronic workpiece 25. It will be recognized, however, that the contacts 85 can engage either the front side or the backside of the workpiece depending upon the appropriate conductive path between the contacts and the area that is to be plated. Suitable reactor heads 30 with contacts 85 are disclosed in U.S. Pat. No. 6,080,291 and U.S. application Ser. Nos. 09/386,803; 09/386,610; 09/386,197; 09/717,927; and 09/823,948, all of which are expressly incorporated herein in their entirety by reference.

The reactor head 30 can be carried by a lift/rotate apparatus that rotates the reactor head 30 from an upwardly-facing orientation in which it can receive the microelectronic workpiece to a downwardly facing orientation in which the plating surface of the microelectronic workpiece can contact the electroplating solution in reactor base 35. The lift/rotate apparatus can bring the workpiece 25 into contact with the electroplating solution either coplanar or at a given angle. A robotic system, which can include an end effector, is typically employed for loading/unloading the microelectronic workpiece 25 on the head 30. It will be recognized that other reactor assembly configurations may be used with the inventive aspects of the disclosed reactor chamber, the foregoing being merely illustrative.

The reactor base 35 can include an outer overflow container 37 and an interior processing container 39. A flow of electroplating fluid flows into the processing container 39 through an inlet 42 (arrow I). The electroplating fluid flows through the interior of the processing container 39 and overflows a weir 44 at the top of processing container 39 (arrow F). The fluid overflowing the weir 44 then passes through an overflow container 37 and exits the reactor 20 through an outlet 46 (arrow O). The fluid exiting the outlet 46 may be directed to a recirculation system, chemical replenishment system, disposal system, etc.

The reactor 20 also includes an electrode in the processing container 39 to contact the electrochemical processing fluid (e.g., the electroplating fluid) as it flows through the reactor 20. In the embodiment of FIG. 3, the reactor 20 includes an electrode assembly 50 having a base member 52 through which a plurality of fluid flow apertures 54 extend. The fluid flow apertures 54 assist in disbursing the electroplating fluid flow entering inlet 42 so that the flow of electroplating fluid at the surface of microelectronic workpiece 25 is less localized and has a desired radial distribution. The electrode assembly 50 also includes an electrode array 56 that can comprise a plurality of individual electrodes 58 supported by the base member 52. The electrode array 56 can have several configurations, including those in which electrodes are disposed at different distances from the microelectronic workpiece. The particular physical configuration that is utilized in a given reactor can depend on the particular type and shape of the microelectronic workpiece 25. In the illustrated embodiment, the microelectronic workpiece 25 is a disk-shaped semiconductor wafer. Accordingly, the present inventors have found that the individual electrodes 58 may be formed as rings of different diameters and that they may be arranged concentrically in alignment with the center of microelectronic workpiece 25. It will be recognized, however, that grid arrays or other electrode array configurations may also be employed without departing from the scope of the present invention. One suitable configuration of the reactor base 35 and electrode array 56 is disclosed in U.S. Ser. No. 09/804,696, filed Mar. 12, 2001, while another suitable configuration is disclosed in U.S. Ser. No. 09/804,697, filed Mar. 12, 2001, both of which are hereby incorporated by reference.

When the reactor 20 electroplates at least one surface of microelectronic workpiece 25, the plating surface of the workpiece 25 functions as a cathode in the electrochemical reaction and the electrode array 56 functions as an anode. To this end, the plating surface of workpiece 25 is connected to a negative potential terminal of a power supply 60 through contacts 85 and the individual electrodes 58 of the electrode array 56 are connected to positive potential terminals of the supply 60. In the illustrated embodiment, each of the individual electrodes 58 is connected to a discrete terminal of the supply 60 so that the supply 60 may individually set and/or alter one or more electrical parameters, such as the current flow, associated with each of the individual electrodes 58. As such, each of the individual electrodes 58 of FIG. 3 is an individually controllable electrode. It will be recognized, however, that one or more of the individual electrodes 58 of the electrode array 56 may be connected to a common node/terminal of the power supply 60. In such instances, the power supply 60 will alter the one or more electrical parameters of the commonly connected electrodes 58 concurrently, as opposed to individually, thereby effectively making the commonly connected electrodes 58 a single, individually controllable electrode. As such, individually controllable electrodes can be physically distinct electrodes that are connected to discrete terminals of power supply 60 as well as physically distinct electrodes that are commonly connected to a single discrete terminal of power supply 60. The electrode array 56 preferably comprises at least two individually controllable electrodes.

The electrode array 56 and the power supply 60 facilitate localized control of the electrical parameters used to electrochemically process the microelectronic workpiece 25. This localized control of the electrical parameters can be used to enhance the uniformity of the electrochemical processing across the surface of the microelectronic workpiece when compared to a single electrode system. Unfortunately, determining the electrical parameters for each of the electrodes 58 in the array 56 to achieve the desired process uniformity can be difficult. The optimizer, however, simplifies and substantially automates the determination of the electrical parameters associated with each of the individually controllable electrodes. In particular, the optimizer determines a plurality of sensitivity values, either experimentally or through numerical simulation, and subsequently uses the sensitivity values to adjust the electrical parameters associated with each of the individually controllable electrodes. The sensitivity values may be placed in a table or may be in the form of a Jacobian matrix. This table/matrix holds information corresponding to process parameter changes (i.e., thickness of the electroplated film) at various points on the workpiece 25 due to electrical parameter perturbations (i.e., electrical current changes) to each of the individually controllable electrodes. This table/matrix is derived from data from a baseline workpiece plus data from separate runs with a perturbation of a controllable electrical parameter to each of the individually controllable electrode.

The optimizer typically executes in a control system 65 that is connected to the power supply 60 in order to supply current values for a plating cycle. The control system 65 can take a variety of forms, including general or special-purpose computer systems, either integrated into the manufacturing tool containing the reaction chamber or separate from the manufacturing tool, such as a laptop or other portable computer system. The control system may be communicatively connected to the power supply 60, or may output current values that are in turn manually inputted to the power supply. Where the control system is connected to the power supply by a network, other computer systems and similar devices may intervene between the control system and the power supply. In many embodiments, the control system contains such components as one or more processors, a primary memory for storing programs and data, a persistent memory for persistently storing programs and data, input/output devices, and a computer-readable medium drive, such as a CD-ROM drive or a DVD drive.

Figure 4:
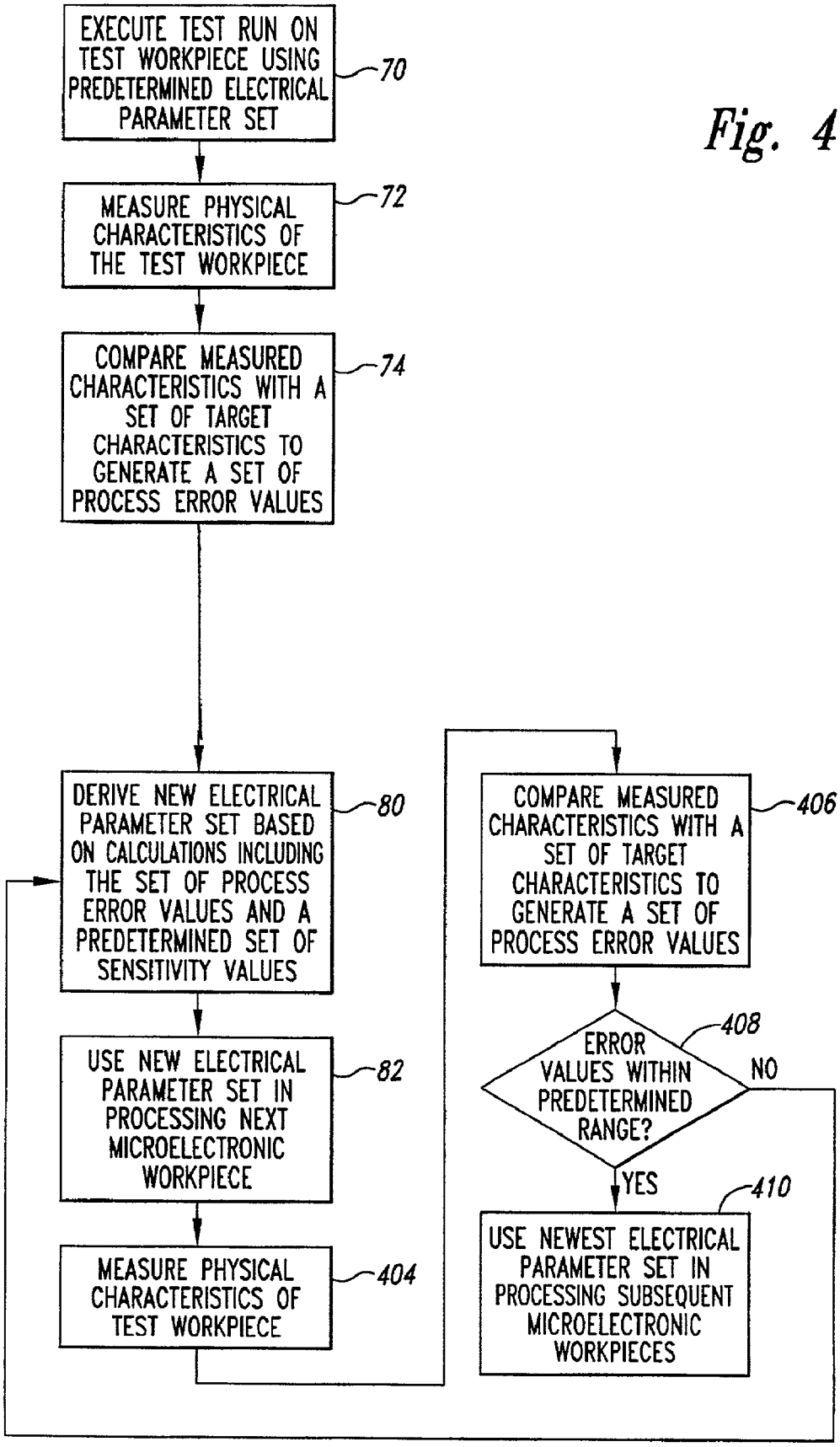
FIG. 4 is a flowchart illustrating one manner in which the optimizer of FIG. 3 can use a predetermined set of sensitivity values to generate a more accurate electrical parameter set for use in meeting targeted physical characteristics in the processing of a microelectronic workpiece.

Once the values for the sensitivity table/matrix have been determined, the values may be stored in and used by control system 65 to control one or more of the electrical parameters that power supply 60 uses in connection with each of the individually controllable electrodes 58. FIG. 4 is a flow diagram illustrating one manner in which the sensitivity table/matrix may be used to calculate an electrical parameter (i.e., current) for each of the individually controllable electrodes 58 that may be used to meet a process target parameter (i.e., target thickness of the electroplated film).

In the steps shown in FIG. 4, the optimizer utilizes two sets of input parameters along with the sensitivity table/matrix to calculate the required electrical parameters. In step 70, the optimizer performs a first plating cycle (a "test run") using a known, predetermined set of electrical parameters. For example, a test run can be performed by subjecting a microelectronic workpiece 25 to an electroplating process in which the current provided to each of the individually controllable electrodes 58 is fixed at a predetermined magnitude for a given period of time.

In step 72, after the test run is complete, the optimizer measures the physical characteristics (i.e., thickness of the electroplated film) of the test workpiece to produce a first set of parameters. For example, in step 72, the test workpiece may be subjected to thickness measurements using a metrology station, producing a set of parameters containing thickness measurements at each of a number of points on the test workpiece. In step 74, the optimizer compares the physical characteristics of the test workpiece measured in step 72 against a second set of input parameters. In the illustrated embodiment of the method, the second set of input parameters corresponds to the target physical characteristics of the microelectronic workpiece that are to be ultimately achieved by the process (i.e., the thickness of the electroplated film). Notably, the target physical characteristics can either be uniform over the surface of the microelectronic workpiece 25 or vary over the surface. For example, in the illustrated embodiment, the thickness of an electroplated film on the surface of the microelectronic workpiece 25 can be used as the target physical characteristic, and the user may expressly specify the target thicknesses at various radial distances from the center of the workpiece, a grid relative to the workpiece, or other reference systems relative to fiducials on the workpiece.

In step 74, the optimizer uses the first and second set of input parameters to generate a set of process error values. In step 80, the optimizer derives a new electrical parameter set based on calculations including the set of process error values and the values of the sensitivity table/matrix. In step 82, once the new electrical parameter set is derived, the optimizer directs power supply 60 to use the derived electrical parameters in processing the next microelectronic workpiece. Then, in step 404, the optimizer measures physical characteristics of the test workpiece in a manner similar to step 72. In step 406, the optimizer compares the characteristics measured in step 404 with a set of target characteristics to generate a set of process error values. The set of target characteristics may be the same set of target characteristics as used in step 74, or may be a different set of target characteristics. In step 408, if the error values generated in step 406 are within a predetermined range, then the optimizer continues in step 410, else the facility continues in 80. In step 80, the optimizer derives a new electrical parameter set. In step 410, the optimizer uses the newest electrical parameter derived in step 80 in processing subsequent microelectronic workpieces. In some embodiments (not shown), the processed microelectronic workpieces, and/or their measured characteristics are examined, either manually or automatically, in order to further troubleshoot the process.

With reference again to FIG. 3, the first and second set of input parameters may be provided to the control system 65 by a user interface 64 and/or a metrics tool 86. The user interface 64 can include a keyboard, a touch-sensitive screen, a voice recognition system, and/or other input devices. The metrics tool 86 may be an automated tool that is used to measure the physical characteristics of the test workpiece after the test run, such as a metrology station. When both a user interface 64 and a metrics tool 86 are employed, the user interface 64 may be used to input the target physical characteristics that are to be achieved by the process while metrics tool 86 may be used to directly communicate the measured physical characteristics of the test workpiece to the control system 65. In the absence of a metrics tool that can communicate with control system 65, the measured physical characteristics of the test workpiece can be provided to control system 65 through the user interface 64, or by removable data storage media, such as a floppy disk. It will be recognized that the foregoing are only examples of suitable data communications devices and that other data communications devices may be used to provide the first and second set of input parameters to control system 65.

In order to predict change in thickness as a function of change in current, the optimizer generates a Jacobian sensitivity matrix. An example in which the sensitivity matrix generated by the optimizer is based upon a mathematical model of the reaction chamber is discussed below. In additional embodiments, however, the sensitivity matrix used by the optimizer is based upon experimental results produced by operating the actual reaction chamber. The data modeled in the sensitivity matrix includes a baseline film thickness profile and as many perturbation curves as anodes, where each perturbation curve involves adding roughly 0.05 amps to one specific anode. The Jacobian is a matrix of partial derivatives, representing the change in thickness in microns over the change in current in amp minutes. Specifically, the Jacobian is an $m \times n$ matrix where m, the number of rows, is equal to the number of radial location data points in the modeled data and n, the number of columns, is equal to the number of anodes on the reactor. Typically, the value of m is relatively large (>100) due to the computational mesh chosen for the model of the chamber. The components of the matrix are calculated by taking the quotient of the difference in thickness due to the perturbed anode and the current change in amp-minutes, which is the product of the current change in amps and the run time in minutes.

As one source of feedback control, the optimizer uses the thickness of the most-recently plated wafer at each of a number of radial positions on the plated wafer. These radial positions may either be selected from the radial positions corresponding to the rows of the matrix, or may be interpolated between the radial positions corresponding to the rows of the matrix. A wide range of numbers of radial positions may be used. As the number of radial positions used increases, the optimizer's results in terms of coating uniformity improves. However, as the number of radial positions used increases, the amount of time required to measure the wafer, to input the measurement results, and/or to operate the optimizer to generate new currents can increase. Accordingly, the smallest number of radial positions that produce acceptable results is typically used. One approach is to use the number of radial test points within a standard metrology contour map (4 for 200 mm and 4 or 6 for 300 mm) plus one, where the extra point is added to better the 3 sigma uniformity for all the points (i.e., to better the diameter scan).

A specific measurement point map may be designed for the metrology station, which will measure the appropriate points on the wafer corresponding with the radial positions necessary for the optimizer operation.

Figure 5:
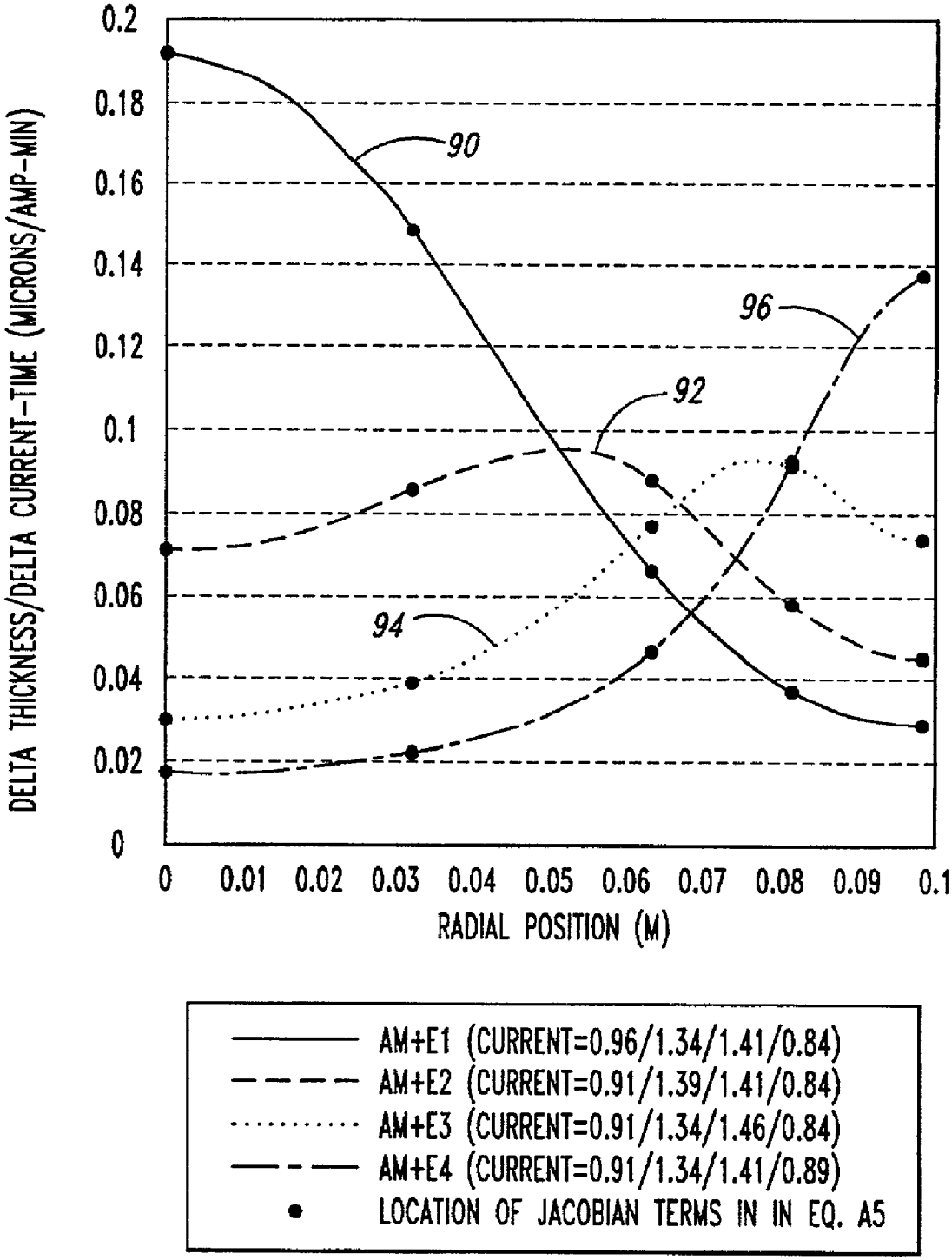
FIG. 5 is a graph of a sample Jacobian sensitivity matrix for a multiple-electrode reaction chamber.

The optimizer can further be understood with reference to a specific embodiment in which the electrochemical process is electroplating, the thickness of the electroplated film is the target physical parameter, and the current provided to each of the individually controlled electrodes 58 is the electrical parameter that is to be controlled to achieve the target film thickness. In accordance with this specific embodiment, a Jacobian sensitivity matrix is first derived from experimental or numerically simulated data. FIG. 5 is a graph of a sample Jacobian sensitivity matrix for a multiple-electrode reaction chamber. In particular, FIG. 5 is a graph of a sample change in electroplated film thickness per change in current-time as a function of radial position on the microelectronic workpiece 25 for each of a number of individually controlled electrodes, such as anodes A1–A4 shown in FIG. 3. A first baseline workpiece is electroplated for a predetermined period of time by delivering a predetermined set of current values to electrodes in the multiple anode reactor. The thickness of the resulting electroplated film is then measured as a function of the radial position on the workpiece. These data points are then used as baseline measurements that are compared to the data acquired as the current to each of the anodes A1–A4 is perturbated. Line 90 is a plot of the Jacobian terms associated with a perturbation in the current provided by power supply 60 to anode A1 with the current to the remaining anodes A2–A4 held at their constant predetermined values. Line 92 is a plot of the Jacobian terms associated with a perturbation in the current provided by power supply 60 to anode A2 with the current to the remaining anodes A1 and A3–A4 held at their constant predetermined values. Line 94 is a plot of the Jacobian terms associated with a perturbation in the current provided by power supply 60 to anode A3 with the current to the remaining anodes A1–A2 and A4 held at their constant predetermined values. Lastly, line 96 is a plot of the Jacobian terms associated with a perturbation in the current provided by power supply 60 to anode A4 with the current to the remaining anodes A1–A3 held at their constant predetermined values.

The data for the Jacobian parameters shown in FIG. 5 may be computed using the following equations:

$$J_{ij} = \frac{\partial t_i}{\partial AM_j} \cong \frac{t_i(AM + \varepsilon_j) - t_i(AM)}{|\varepsilon_j|} \quad \text{Equation (A1)}$$

$$t(AM)=[t_1(AM)t_2(AM) \ldots t_m(AM)] \quad \text{Equation (A2)}$$

$$AM=[AM_1AM_2 \ldots AM_n] \quad \text{Equation (A3)}$$

$$\varepsilon_1 = \begin{bmatrix} \Delta AM_1 \\ 0 \\ . \\ . \\ 0 \end{bmatrix} \quad \text{Equation (A4)}$$

$$\varepsilon_2 = \begin{bmatrix} 0 \\ \Delta AM_2 \\ 0 \\ . \\ 0 \end{bmatrix} \ldots$$

$$\varepsilon_n = \begin{bmatrix} 0 \\ . \\ . \\ 0 \\ \Delta AM_n \end{bmatrix}$$

where:

t represents thickness [microns];

AM represents current [amp-minutes];

$\epsilon$ represents perturbation [amp-minutes];

i is an integer corresponding to a radial position on the workpiece;

j is an integer representing a particular anode;

m is an integer corresponding to the total number of radial positions on the workpiece; and n is an integer representing the total number of individually-controllable anodes.

The Jacobian sensitivity matrix, set forth below as Equation (A5), is an index of the Jacobian values computed using Equations (A1)–(A4). The Jacobian matrix may be generated either using a simulation of the operation of the deposition chamber based upon a mathematical model of the deposition chamber, or using experimental data derived from the plating of one or more test wafers. Construction of such a mathematical model, as well as its use to simulate operation of the modeled deposition chamber, is discussed in detail in G. Ritter, P. McHugh, G. Wilson and T. Ritzdorf, "Two- and three- dimensional numerical modeling of copper electroplating for advanced ULSI metallization," Solid State Electronics, volume 44, issue 5, pp. 797–807 (May 2000), available from http://www.elsevier.nl/gej-ng/10/30/25/29/28/27/article.pdf, also available from http://journals.ohiolink.edu/pdflinks/01040215463800982.pdf.

$$J = \begin{vmatrix} 0.192982 & 0.071570 & 0.030913 & 0.017811 \\ 0.148448 & 0.084824 & 0.039650 & 0.022264 \\ 0.066126 & 0.087475 & 0.076612 & 0.047073 \\ 0.037112 & 0.057654 & 0.090725 & 0.092239 \\ 0.029689 & 0.045725 & 0.073924 & 0.138040 \end{vmatrix} \quad \text{Equation (A5)}$$

The values in the Jacobian matrix are also presented as highlighted data points in the graph of FIG. 5. These values correspond to the radial positions on the surface of a semiconductor wafer that are typically chosen for measurement. Once the values for the Jacobian sensitivity matrix have been derived, they may be stored in control system 65 for further use.

Table 1 below sets forth exemplary data corresponding to a test run in which a 200 mm wafer is plated with copper in a multiple anode system using a nominally 2000 Å thick initial copper seed-layer. Identical currents of 1.12 Amps (for 3 minutes) were provided to all four anodes A1–A4. The resulting thickness at five radial locations was then measured and is recorded in the second column of Table 1. The 3 sigma uniformity of the wafer is 9.4% using a 49 point contour map. Target thickness were then provided and are set forth in column 3 of Table 1. In this example, because a flat coating is desired, the target thickness is the same at each radial position. The thickness errors (processed errors) between the plated film and the target thickness were then calculated and are provided in the last column of Table 1. These calculated thickness errors are used by the optimizer as a source of feedback control.

TABLE 1

DATA FROM WAFER PLATED WITH 1.12 AMPS TO EACH ANODE.

| Radial Location (m) | Measured Thickness (microns) | Target Thickness (microns) | Error (microns) |
|---|---|---|---|
| 0 | 1.1081 | 1.0291 | −0.0790 |
| 0.032 | 1.0778 | 1.0291 | −0.0487 |
| 0.063 | 1.0226 | 1.0291 | 0.0065 |
| 0.081 | 1.0169 | 1.0291 | 0.0122 |
| 0.098 | 0.09987 | 1.0291 | 0.0304 |

The Jacobian sensitivity matrix may then be used along with the thickness error values to provide a revised set of anode current values that should yield better film uniformity. The equations summarizing this approach are set forth below:

$$\Delta AM = J^{-1}\Delta t \qquad \text{Equation (B1)}$$

(for a square system in which the number of measured radial positions corresponds to the number of individually controlled anodes in the system); and $$\Delta AM = (J^T J)^{-1} J^T \Delta t \qquad \text{Equation (B2)}$$

(for a non-square system in which the number of measured radial positions is different than the number of individually controlled anodes in the system).

$$\Delta t_l = t_l^{target} - t_l^{old} - (t_l^{new\ seed} - t_l^{old\ seed}) + t_l^{specified} \qquad \text{Equation (B3)}$$

In Equation (B3), $t_l^{target}$ is the target thickness required to obtain a wafer of desired profile while considering the total current adjustment, $t_l^{old}$ is the old overall thickness, $t_l^{new\ seed}$ is the thickness of the new seed layer, $t_l^{old\ seed}$ is the thickness of the old seed layer, and $t_l^{specified}$ is the thickness specification relative to the center of the wafer, that is, the thickness specified by the target plating profile. In particular, the term $t_l^{specified}$ represents the target thickness, while the quantity $t_l^{target} - t_l^{old}$ represents feedback from the previous wafer, and the quantity $t_l^{new\ seed} - t_l^{old\ seed}$ represents feedforward from the thickness of the seed layer of the incoming wafer—to disable feedback control, the first quantity is omitted from equation (B3); to disable feedforward control, the second quantity is omitted from equation (B3).

Table 2 shows the foregoing equations as applied to the given data set and the corresponding current changes that have been derived from the equations to meet the target thickness at each radial location (best least square fit). Such application of the equations, and construction of the Jacobian matrix is in some embodiments performed using a spreadsheet application program, such as Microsoft Excel®, in connection with specialized macro programs. In other embodiments, different approaches are used in constructing the Jacobian matrix and applying the above equations.

The wafer uniformity obtained with the currents in the last column of Table 2 was 1.7% (compared to 9.4% for the test run wafer). This procedure can be repeated again to try to further improve the uniformity. In this example, the differences between the seed layers were ignored since the seed layers are substantially the same.

TABLE 2

CURRENT ADJUSTMENT

| Anode # | Anode Currents for Run #1 (Amps) | Change to Anode Currents (Amps) | Anode Currents for Run #2 (Amps) |
|---|---|---|---|
| 1 | 1.12 | −0.21 | 0.91 |
| 2 | 1.12 | 0.20 | 1.32 |
| 3 | 1.12 | −0.09 | 1.03 |
| 4 | 1.12 | 0.10 | 1.22 |

Once the corrected values for the anode currents have been calculated, control system 65 of FIG. 3 directs power supply 60 to provide the corrected current to the respective anode A1–A4 during subsequent processes to meet the target film thickness and uniformity.

In some instances, it may be desirable to iteratively apply the foregoing equations to arrive at a set of current change values (the values shown in column 3 of Table 2) that add up to zero. For example, doing so enables the total plating charge—and therefore the total mass of plated material—to be held constant without having to vary the recipe time.

The Jacobian sensitivity matrix in the foregoing example quantifies the system response to anode current changes about a baseline condition. Ideally, a different matrix may be employed if the processing conditions vary significantly from the baseline. The number of system parameters that may influence the sensitivity values of the sensitivity matrix is quite large. Such system parameters include the seed layer thickness, the electrolyte conductivity, the metal being plated, the film thickness, the plating rate, the contact ring geometry, the wafer position relative to the chamber, and the anode shape/current distribution. Anode shape/current distribution is included to accommodate chamber designs where changes in the shape of consumable anodes over time affect plating characteristics of the chamber. Changes to all of these items can change the current density across the wafer for a given set of anode currents and, as a result, can change the response of the system to changes in the anode currents. It is expected, however, that small changes to many of these parameters will not require the calculation of a new sensitivity matrix. Nevertheless, a plurality of sensitivity tables/matrices may be derived for different processing conditions and stored in control system 65. Which of the sensitivity tables/matrices is to be used by the control system 65 can be entered manually by a user, or can be set automatically depending on measurements taken by certain sensors or the like (i.e., temperature sensors, chemical analysis units, etc.) that indicate the existence of one or more particular processing conditions.

The optimizer may also be used to compensate for differences and non-uniformities of the initial seed layer of the microelectronic workpiece. Generally stated, a blanket seed layer can affect the uniformity of a plated film in two ways:

1. If the seed layer non-uniformity changes, this non-uniformity is added to the final film. For example, if the seed layer is 100 Å thinner at the outer edge than expected, the final film thickness may also be 100 Å thinner at the outer edge.

2. If the average seed-layer thickness changes significantly, the resistance of the seed-layer will change resulting in a modified current density distribution across the wafer and altered film uniformity. For example, if the seed layer decreases from 2000 Å to 1000 Å, the final film will not only be thinner (because the initial film is thinner) but it will also be relatively thicker at the outer edge due to the higher resistivity of the 1000 Å seed-layer compared to the 2000 Å seed-layer (assuming an edge contact).

The optimizer can be used to compensate for such seed-layer deviations, thereby utilizing seed-layer thicknesses as a source of feed-forward control. In the first case above, the changes in seed-layer uniformity may be handled in the same manner that errors between target thickness and measured thickness are handled. A pre-measurement of the wafer quantifies changes in the seed-layer thickness at the various radial measurement locations and these changes (errors) are figured into the current adjustment calculations. Using this approach, excellent uniformity results can be obtained on the new seed layer, even on the first attempt at electroplating.

In the second case noted above, an update of or selection of another stored sensitivity/Jacobian matrix can be used to account for a significantly different resistance of the seed-layer. A simple method to adjust for the new seed layer thickness is to plate a film onto the new seed layer using the same currents used in plating a film on the previous seed layer. The thickness errors measured from this wafer can be used with a sensitivity matrix appropriate for the new seed-layer to adjust the currents.

To further illuminate the operation of the optimizer, a second test run is described. In the second test run, the optimization process begins with a baseline current set or standard recipe currents. A wafer must be pre-read for seed layer thickness data, and then plated using the indicated currents. After plating, the wafer is re-measured for the final thickness values. The following wafer must also be pre-read for seed layer thickness data. Sixty-seven points at the standard five radial positions (0 mm, 31.83 mm, 63.67 mm, 80 mm, 95.5 mm) are typically measured and averaged for each wafer reading.

The thickness data from the previous wafer, and the new wafer seed layer, in addition to the anode currents, are entered into the input page of the optimizer. The user may also elect to input a thickness specification, or chose to modify the plating thickness by adjusting the total current in amp-minutes. After all the data is correctly inputted, the user activates the optimizer. In response, the optimizer predicts thickness changes and calculates new currents.

The new wafer is then plated with the adjusted anode currents and then measured. A second modification may be required if the thickness profile is not satisfactory.

When a further iteration is required, the optimization is continued. As before, the post-plated wafer is measured for thickness values, and another wafer is pre-read for a new seed set of seed layer thickness values. Then, the following quantities are entered on the input page:

1. plated wafer thickness,
2. anode currents,
3. plated wafer seed layer thickness, and
4. new wafer seed layer thickness The recipe time and thickness profile specification should be consistent with the previous iteration. The program is now ready to be run again to provide a new set of anode currents for the next plating attempt.

After plating with the new currents, the processed wafer is measured and if the uniformity is still not acceptable, the procedure may be continued with another iteration. The standard value determining the uniformity of a wafer is the 3-σ, which is the standard deviation of the measured points relative to the mean and multiplied by three. Usually a forty-nine point map is used with measurements at the radial positions of approximately 0 mm, 32 mm, 64 mm, and 95 mm to test for uniformity.

The above procedure will be demonstrated using a multi-iteration example. Wafer #3934 is the first plated wafer using a set of standard anode currents: 0.557/0.818/1.039/0.786 (anode1/anode2/anode3/anode4 in amps) with a recipe time of 2.33 minutes (140 seconds). Before plating, the wafer is pre-read for seed layer data. These thickness values, in microns, from the center to the outer edge, are shown in Table 3:

TABLE 3

SEED LAYER THICKNESS VALUES FOR WAFER #3934

| Radius (mm) | Thickness (μm) |
|---|---|
| 0.00 | 0.130207 |
| 31.83 | 0.13108 |
| 63.67 | 0.131882 |
| 80.00 | 0.129958 |
| 95.50 | 0.127886 |

The wafer is then sent to the plating chamber, and then re-measured after being processed. The resulting thickness values (in microns) for the post-plated wafer #3934 are shown in Table 4:

TABLE 4

THICKNESS VALUES FOR POST-PLATED WAFER #3934

| Radius (mm) | Thickness (μm) |
|---|---|
| 0.00 | 0.615938 |
| 31.83 | 0.617442 |
| 63.67 | 0.626134 |
| 80.00 | 0.626202 |
| 95.50 | 0.628257 |

The 3-σ for the plated wafer is calculated to be 2.67% over a range of 230.4 Angstroms. Since the currents are already producing a wafer below 3%, any adjustments are going to be minor. The subsequent wafer has to be pre-read for seed layer values in order to compensate for any seed layer differences. Wafer #4004 is measured and the thickness values in microns are shown in Table 5:

TABLE 5

SEED LAYER THICKNESS VALUES FOR WAFER #4004

| Radius (mm) | Thickness (μm) |
|---|---|
| 0.00 | 0.130308 |
| 31.83 | 0.131178 |
| 63.67 | 0.132068 |
| 80.00 | 0.13079 |
| 95.50 | 0.130314 |

Figure 6:
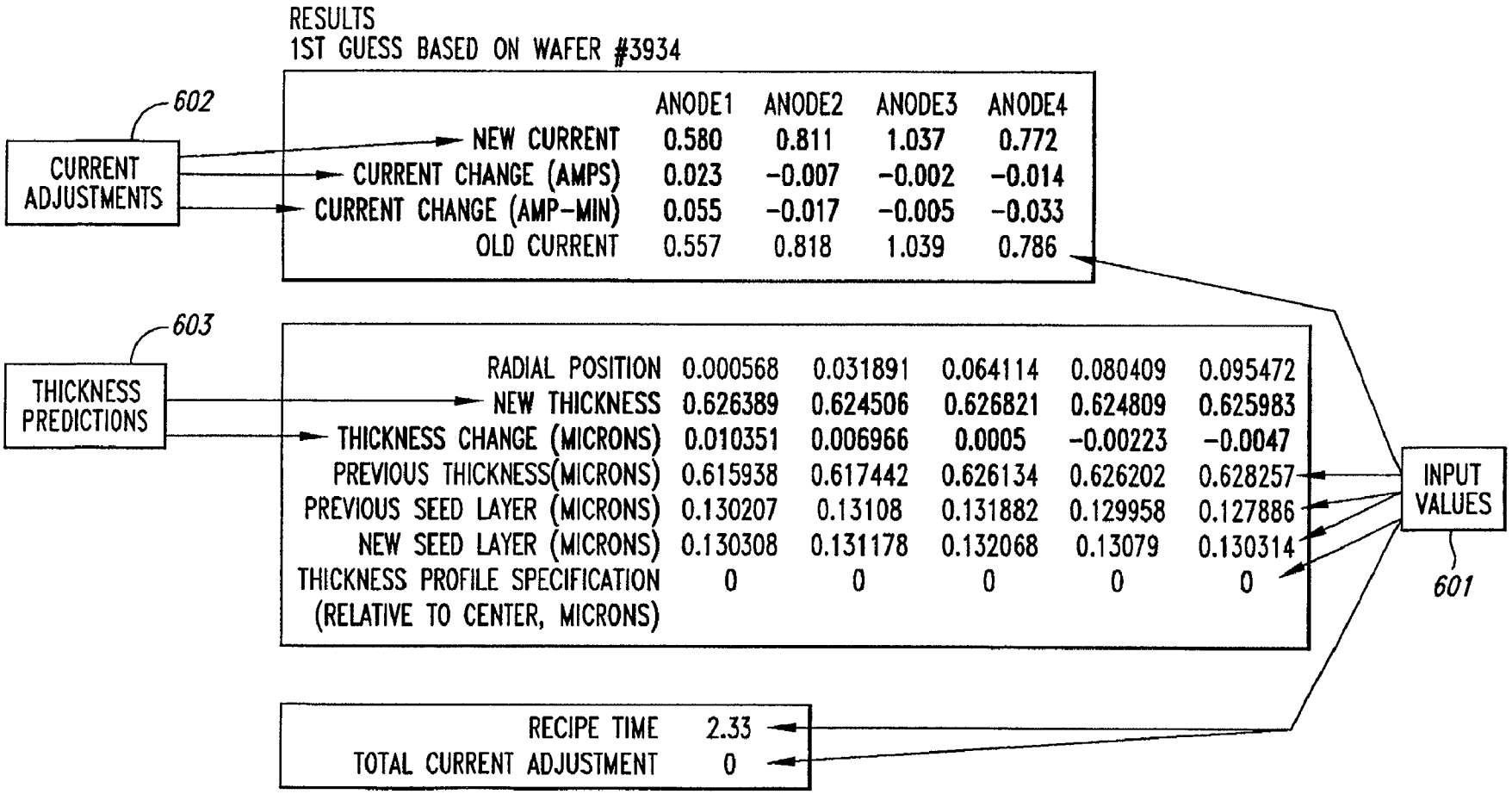
FIG. 6 is a spreadsheet diagram showing the new current outputs calculated from the inputs for the first optimization run.

For this optimization run, there is no thickness profile specification, or overall thickness adjustment. All of the preceding data is inputted into the optimizer, and the optimizer is activated to generate a new set of currents. These currents will be used to plate the next wafer. FIG. 6 is a spreadsheet diagram showing the new current outputs calculated from the inputs for the first optimization run. It can be seen that the input values 601 have generated output 602, including a new current set. The optimizer has also predicted the absolute end changed thicknesses 603 that this new current set will produce.

The new anode currents are sent to the process recipe and run in the plating chamber. The run time and total currents (amp-minutes) remain constant, and the current density on the wafer is unchanged. The new seed layer data from this run for wafer #4004 will become the old seed layer data for the next iteration.

The thickness (microns) resulting from the adjusted currents plated on wafer #4004 are shown in Table 6:

TABLE 6

THICKNESS VALUES FOR POST-PLATED WAFER #4004

| Radius (mm) | Thickness (μm) |
|---|---|
| 0.00 | 0.624351 |
| 31.83 | 0.621553 |
| 63.67 | 0.622704 |
| 80.00 | 0.62076 |
| 95.50 | 0.618746 |

The post-plated wafer has a 3-σ of 2.117% over a range of 248.6 Angstroms. To do another iteration, a new seed layer measurement is required, unless notified that the batch of wafers has equivalent seed layers. Wafer #4220 is pre-measured and the thickness values in microns are shown in Table 7:

TABLE 7

SEED LAYER THICKNESS VALUES FOR WAFER #4220

| Radius (mm) | Thickness (μm) |
|---|---|
| 0.00 | 0.127869 |
| 31.83 | 0.129744 |
| 63.67 | 0.133403 |
| 80.00 | 0.134055 |
| 95.50 | 0.1335560 |

Figure 7:
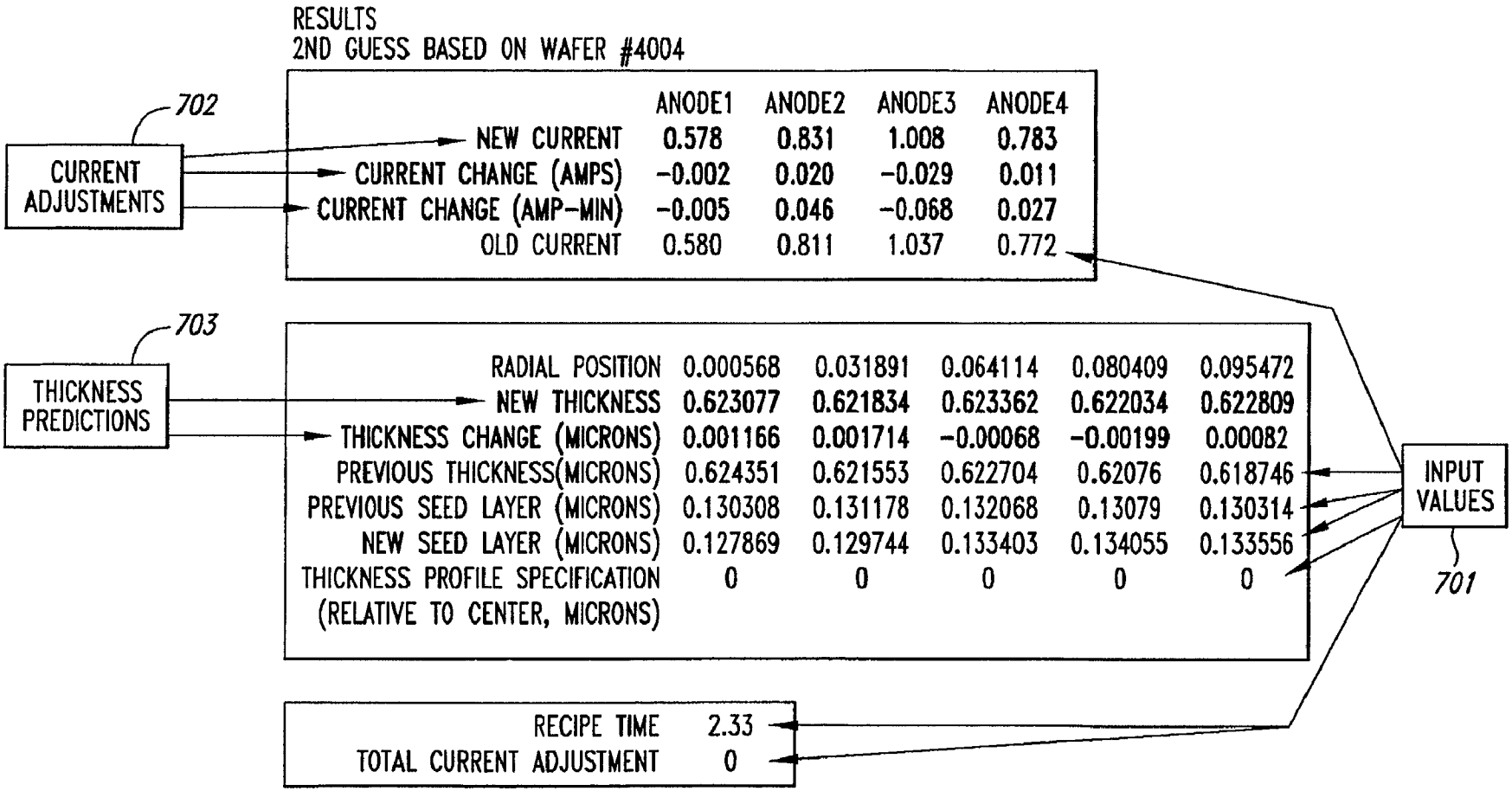
FIG. 7 is a spreadsheet diagram showing the new current outputs calculated from the inputs for the second optimization run.

Again, all of the new data is inputted into the optimizer, along with the currents used to plate the new wafer and the thickness of the plated wafer's seed. The optimizer automatically transfers the new currents into the old currents among the inputs. The optimizer is then activated to generate a new set of currents. FIG. 7 is a spreadsheet diagram showing the new current outputs calculated from the inputs for the second optimization run. It can be seen that, from input value 701, the optimizer has produced output 702 including a new current set. It can further be seen that that the facility has predicted absolute and changed thicknesses 703 that will be produced using the new currents.

The corrected anode currents are again sent to the recipe and applied to the plating process. The $2^{nd}$ adjustments on the anode currents produce the thickness values in microns shown in Table 8:

TABLE 8

THICKNESS VALUES FOR POST-PLATED WAFER #4220

| Radius (mm) | Thickness (μm) |
|---|---|
| 0.00 | 0.624165 |
| 31.83 | 0.622783 |
| 63.67 | 0.626911 |
| 80.00 | 0.627005 |
| 95.50 | 0.623823 |

The 3-σ for wafer #4220 is 1.97% over a range of 213.6 Angstroms. The procedure may continue to better the uniformity, but the for the purpose of this explanation, a 3-σ below 2% is acceptable.

The optimizer may also be used to compensate for reactor-to-reactor variations in a multiple reactor system, such as the LT-210C™ available from Semitool, Inc., of Kalispell, Mont. In such a system, there is a possibility that the anode currents required to plate a specified film might be different on one reactor when compared to another. Some possible sources for such differences include variations in the wafer position due to tolerances in the lift-rotate mechanism, variations in the current provided to each anode due to power supply manufacturing tolerances, variations in the chamber geometry due to manufacturing tolerances, variations in the plating solution, etc.

In a single anode system, the reactor-to-reactor variation is typically reduced either by reducing hardware manufacturing tolerances or by making slight hardware modifications to each reactor to compensate for reactor variations. In a multiple anode reactor constructed in accordance with the teachings of the present invention, reactor-to-reactor variations can be reduced/eliminated by running slightly different current sets in each reactor. As long as the reactor variations do not fundamentally change the system response (i.e., the sensitivity matrix), the self-tuning scheme disclosed herein is expected to find anode currents that meet film thickness targets. Reactor-to-reactor variations can be quantified by comparing differences in the final anode currents for each chamber. These differences can be saved in one or more offset tables in the control system 65 so that the same recipe may be utilized in each reactor. In addition, these offset tables may be used to increase the efficiency of entering new processing recipes into the control system 65. Furthermore, these findings can be used to trouble-shoot reactor set up. For example, if the values in the offset table are over a particular threshold, the deviation may indicate a hardware deficiency that needs to be corrected.

As mentioned above, embodiments of the optimizer may be used to set currents and other parameters for complex deposition recipes that specify changes in current during the deposition cycle. As an example, embodiments of the optimizer may be used to determine anode currents in accordance with recipe having two different steps. Step 1 of the recipe lasts for 0.5 minutes, during which a total of +1 amp of current is delivered through four electrodes. Step 2 of the recipe, which immediately follows step 1, is 1.25 minutes long. During step 2, a total current of +9 amps is delivered for 95 milliseconds. Immediately afterwards, a total current of −4.3 amps is delivered for 25 milliseconds. Ten milliseconds after delivery of the −4.3 amp current is concluded, the cycle repeats, delivering +9 amps for another 95 milliseconds. The period during which a positive current is being delivered is known as the "forward phase" of the step, while the time during which a negative current is being delivered is known as the "backward phase" of the step. Backward phases may be used, for example, to reduce irregularities formed in the plated surface as the result of organic substances within the plating solution.

In order to apply the optimizer to optimize currents for this recipe, initial currents are chosen in accordance with the recipe. These are shown below in Table 9.

TABLE 9

Initial Multi-step Recipe

| | | Step 1 | Step 2 |
|---|---|---|---|
| 1. | time | 0.5 | 1.25 |
| 2. | forward fraction | 1 | 0.730769 |
| 3. | anode 1 current | 0.2 | 1.8 |
| 4. | anode 2 current | 0.24 | 2.16 |
| 5. | anode 3 current | 0.34 | 3.06 |
| 6. | anode 4 current | 0.22 | 1.98 |
| 7. | backward fraction | | 0.192307 |
| 8. | anode 1 current | | −0.86 |
| 9. | anode 2 current | | −1.03 |
| 10. | anode 3 current | | −1.46 |
| 11. | anode 4 current | | −0.95 |
| 12. | forward amp-min | 0.5 | 8.221153 |
| 13. | backward amp-min | 0 | −1.033653 |
| 14. | Total Amp-min | 7.6875 | |

The left-hand column of Table 9 shows currents and other information for the first step of the recipe, while the right-hand column shows currents and other information for the second step of the recipe. In line 1, it can be seen that step 1 has a duration of 0.5 minutes, while step 2 has a duration of 1.25 minutes. In line 2, it can be seen that, in step 1, forward plating is performed for 100% of the duration of the step, while in step 2, forward plating is performed for about 73% of the duration of the step (95 milliseconds out of the 130 millisecond period of the step). Lines 3–6 show the currents delivered through each of the anodes during the forward phase of each of the two steps. For example, it can be seen that 0.24 amps are delivered through anode 2 for the duration of step 1. In line 7, it can be seen that a negative current is delivered for about 19% of the duration of step 2 (25 milliseconds out of the total period of 130 milliseconds). Lines 8–11 show the negative currents delivered during the backward phase of step 2. Line 12 shows the charge, in amp-minutes, delivered in the forward phase of each step. For step 1, this is 0.5 amp-minutes, computed by multiplying the step 1 duration of 0.5 minutes by the forward fraction of 1, and by the sum of step 1 forward currents, 1 amp. The forward plating charge for step 2 is about 8.22 amp-minutes, computed by multiplying the duration of step 2, 1.25 minutes, by the forward fraction of about 73%, and by the sum of the forward currents in step 2, 9 amps. Line 13 shows the results of a similar calculation for the backward phase of step 2. Line 14 shows the net plating charge, 7.6875 amp-minutes obtained by summing the signed charge values on lines 12 and 13.

The deposition chamber is used to deposit a wafer in accordance with these initial currents. That is, during the first half-minute of deposition (step 1), +0.2 amps are delivered through anode 1. During the next 1.25 minutes of the process (step 2), +1.8 amps are delivered through anode 1 for 95 milliseconds, then −0.86 amps are delivered through anode 1 for 25 milliseconds, then no current flows through 1 for 10 milliseconds, and then the cycle is repeated until the end of the 1.25 minute duration of step 2. Overall, the charge of 1.537 amp-minutes is delivered through anode 1. This value is determined by multiplying duration, forward fraction, and anode 1 current from step 1, then adding the product of the duration of step 2, the forward fraction of step 2, and the forward anode 1 current of step 2, then adding the product of the duration of step 2, the backward fraction of step 2, and the backward anode 1 current of step 2. Such net plating charges may be calculated for each of the anodes, as shown below in Table 10.

TABLE 10

Net Plating Charges in Initial Multi-step Recipe

| | |
|---|---|
| Anode1 | 1.537 Amp-min |
| Anode2 | 1.845 Amp-min |
| Anode3 | 2.614 Amp-min |
| Anode4 | 1.690 Amp-min |

These plating charge values are submitted to the optimizer together with thicknesses measured from the wafer plated using the initial current. In response, the optimizer generates a set of new net plating charges for each electrode. These new net plating charges are shown below in Table 11.

TABLE 11

New Net Plating Charges for Revised Recipe

| | |
|---|---|
| Anode1 | 1.537 Amp-min + 0.171286 Amp-min = 1.709 Amp-min |
| Anode2 | 1.845 Amp-min − 0.46657 Amp-min = 1.379 Amp-min |
| Anode3 | 2.614 Amp-min + 0.106337 Amp-min = 1.271 Amp-min |
| Anode4 | 1.690 Amp-min + 0.188942 Amp-min = 1.879 Amp-min |

The optimizer then computes for each anode a share of the current to be delivered through the anode by dividing the new net plating charge determined for the anode by the sum of the net plating charges determined for all of the anodes. These current shares are shown below in Table 12.

TABLE 12

Current Shares for Revised Recipe

| | |
|---|---|
| Anode1 | 1.709/7.6875 = 22.2% |
| Anode2 | 1.379/7.6875 = 17.9% |
| Anode3 | 1.271/7.6875 = 35.5% |
| Anode4 | 1.879/7.6875 = 24.4% |

The optimizer then determines a new current for each anode in each step and phase of the recipe by multiplying the total current for the step and phase by the current share computed for each anode. These are shown in Table 13 below.

TABLE 13

Revised Multi-Step Recipe

| | | Step 1 | Step 2 |
|---|---|---|---|
| 1. | time | 0.5 | 1.25 |
| 2. | forward fraction | 1 | 0.730769 |
| 3. | anode 1 current | 0.222281 | 2.000530 |
| 4. | anode 2 current | 0.179371 | 1.614339 |
| 5. | anode 3 current | 0.353895 | 3.185055 |
| 6. | anode 4 current | 0.244452 | 2.200075 |
| 7. | backward fraction | | 0.192307 |
| 8. | anode 1 current | 0 | −0.955808 |
| 9. | anode 2 current | 0 | −0.771295 |
| 10. | anode 3 current | 0 | −1.521748 |
| 11. | anode 4 current | 0 | −1.051147 |
| 12. | forward amp-min | 0.5 | 8.221153 |
| 13. | backward amp-min | 0 | −1.033653 |
| 14. | Total Amp-min | 7.6875 | |

For example, it can be seen in line 4 of Table 13 that the forward anode 2 current for step 2 is about 1.61 amps, computed by multiplying the +9 amps total current for the forward phase of step 2 by the current share of 17.9% computed for anode 2 shown in Table 12.

By comparing Table 13 to Table 9, it can be seen that the net plating charge changes specified by the optimizer for the revised recipe are distributed evenly across the steps and phases of this recipe. It can also be seen that the total plating charge for each step and phase of the revised recipe, as well as the total plating charge, is unchanged from the initial multistep recipe. The optimizer may utilize various other schemes for distributing plating charge changes within the recipe. For example, it may alternatively distribute all the changes to step 2 of the recipe, leaving step 1 of the recipe unchanged from the initial multi-step recipe. In some embodiments, the optimizer maintains and applies a different sensitivity matrix for each step in a multi-step recipe.

In some embodiments, the facility utilizes a form of predictive control feedback. In these embodiments, the optimizer generates, for each set of revised currents, a set of predicted plating thicknesses. The optimizer determines the difference between these predicted thicknesses and the actual plated thicknesses of the corresponding workpiece. For each workpiece, this set of differences represents the level of error produced by the optimizer in setting currents for the workpiece. The optimizer uses the set of differences for the previous workpiece to improve performance on the incoming workpiece by subtracting these differences from the target thickness changes to be effected by current changes for the incoming workpiece. In this way, the optimizer is able to more quickly achieve the target plating profile.

Further sample wafer processing processes employing the optimizer are discussed below. It should be noted that no attempt is made to exhaustively list such processes, and that those included are merely exemplary.

Table 13 below shows a sample wafer processing process employing the optimizer, from which a subset of the steps may be selected and/or modified to define additional such processes.

TABLE 13

Sample Wafer Processing Process Employing Optimizer

| Step | Tool/Process |
|---|---|
| 1. | Deposit metal seed layer using one or more physical vapor deposition ("PVD") tools, different chambers on the same PVD tool, or CVD chambers or electroless deposition chambers. |
| 2. | Measure seed layer film thickness using metrology station, either on the tool or an independent station - metrology stations can infer film thickness from sheet resistance measurements or from optical measurements of the film |
| 3. | Apply optimizer -- residing on tool or off tool on a personal computer -- in a seed layer enhancement ("SLE") chamber using measurements from step 2 (feedforward) and measurement results from previous SLE wafer on step 6 or 8 (feedback) |
| 4. | Deposit metal layer in SLE chamber |
| 5. | Rinse wafer in SRD/Capsule chamber |
| 6. | Measure wafer thickness using Metrology Station |
| 7. | Anneal wafer in annealing chamber on the tool or in independent stations |
| 8. | Measure wafer thickness using Metrology Station |
| 9. | Apply optimizer in ECD chamber using measurements from step 7 (feedforward) and measurement results from previous ECD wafer on step 12 or 14 (feedback) |
| 10. | Deposit final metal layer in ECD chamber |
| 11. | Clean and bevel etch wafer in Capsule chamber |
| 12. | Measure wafer thickness using Metrology Station |

TABLE 13-continued

Sample Wafer Processing Process Employing Optimizer

| Step | Tool/Process |
|---|---|
| 13. | Anneal wafer in anneal chamber |
| 14. | Measure wafer thickness using Metrology Station |

These steps may be qualified in a variety of ways including: the measurement/optimizer sequence steps can be performed during tool qualification or "dial-in"; the measurement/optimizer sequence steps sequence can be performed periodically to monitor performance; the measurement/optimizer sequence steps sequence can be performed on each wafer; SLE process may be optional depending upon the measurement results in step 2 (i.e., this wafer may routed around this and associated process steps); wafer sequence may be terminated, rerouted, or restarted based upon the measurement results of step 2, 6, 8, 12, and 14; measurement/optimizer steps may be performed only after process/hardware changes; measurements before and after annealing (e.g., sheet resistance) may be used to determine effectiveness of annealing process; metal deposition steps 4 and may be deposition of same metals or different metals—they could deposit the same metal using different baths; one or more metal deposition steps could be used, which deposit one or more different metals; the optimization steps may adjust currents to generate a flat thickness profile or one with a specified shape; the optimization steps may adjust current to generate a desired current density profile for future filling; the wafer may be returned to a deposition chamber for additional metal deposition if the film thickness is insufficient, based upon metrology results.

Table 14 below shows an additional sample process:

TABLE 14

Sample Wafer Processing Process Employing Optimizer

| Step | Tool/Process |
|---|---|
| 1. | Deposit metal seed layer using PVD tool |
| 2. | Measure seed layer film thickness using metrology station |
| 3. | Apply optimizer in ECD chamber using measurements from step 2 (feedforward) and measurement results from previous ECD wafer on step 7 (feedback) |
| 4. | Deposit final metal layer in ECD chamber |
| 5. | Anneal wafer in anneal chamber |
| 6. | Clean and bevel etch wafer in Capsule chamber |
| 7. | Measure wafer thickness using Metrology Station |

Table 15 below shows an additional sample process:

TABLE 15

Sample Wafer Processing Process Employing Optimizer

| Step | Tool/Process |
|---|---|
| 1. | Deposit metal seed layer using PVD tool |
| 2. | Measure seed layer film thickness using metrology station |
| 3. | Apply optimizer in ECD chamber using measurements from step 2 (feedforward) and measurement results from previous ECD wafer on step 6 (feedback) |
| 4. | Deposit final metal layer in ECD chamber |
| 6. | Clean and bevel etch wafer in Capsule chamber |
| 7. | Measure wafer thickness using Metrology Station |

Table 16 below shows an additional sample process:

TABLE 16

Sample Wafer Processing Process Employing Optimizer

| Step | Tool/Process |
|---|---|
| 1. | Deposit metal seed layer using PVD tool |
| 2. | Measure seed layer film thickness using metrology station |
| 3. | Apply optimizer in ECD chamber using measurements from step 2 (feedforward) and measurement results from previous SLE wafer on step 6 (feedback) |
| 4. | Deposit metal layer in SLE chamber |
| 6. | Clean and bevel etch wafer in Capsule chamber |
| 7. | Measure wafer thickness using Metrology Station |

As an additional sample process, the thickness uniformity of a wafer with a PVD-deposited seed layer is measured on a dedicated metrology tool, after which the wafer is brought to the plating tool and placed in an SLE process chamber. Using the measurements from the dedicated metrology tool, the optimizer is used to select an SLE recipe that will augment the PVD-deposited seed layer to yield a seed layer with improved thickness uniformity, and the SLE process is performed on the wafer. After the wafer has been cleaned and dried in one of the plating tool capsule chambers, the wafer is transferred to a plating chamber where the optimizer is then used to select a plating recipe that will yield a uniform bulk film, at the desired thickness, based on the nominal seed layer thickness. After the bulk film plating process has completed, the wafer is transferred to a capsule cleaning chamber, whereupon it is removed from the tool.

As an additional sample process, a wafer is brought to the plating tool and placed in the on-board metrology station to determine the thickness profile of the CVD-deposited seed layer. The wafer is then transferred to a plating chamber. Using the seed layer measurements from the on-board metrology station, the optimizer is used to select a plating recipe that will yield a convex (center-thick) bulk film, at the desired nominal thickness. After the plating process has completed, the wafer is transferred to a capsule cleaning chamber, whereupon it is removed from the tool.

As an additional sample process, a wafer comes to an electroplating tool with a seed layer, applied using physical vapor deposition, that is non-uniform. A metrology station is used to measure the non-uniformity, and the optimizer operates the multiple-electrode reactor to correct the measured non-uniformity. Seed layer repair is then performed using an electroless ion plating process to produce a final, more uniform, seed layer. The optimizer then operates to deposit bulk metal onto the repaired seed layer.

As an additional sample process, a semiconductor fabricator has two physical vapor deposition tools ("PVD tools"), each of which has its own particular characteristics. A wafer processed by the first PVD tool and having a seed layer non-uniformity is directed to a first multiple-electrode reactor for seed layer repair. A wafer from the second PVD tool that has a different seed layer non-uniformity is directed to a second multiple-electrode reactor for seed layer repair. Bulk metal is then deposited onto the repaired seed layers of the two wafers in a third CFD reactor under the control of the optimizer.

Additional applications of the optimizer include:

Single plating example: The production environment can involve many recipes on a tool because each wafer may require multiple processing steps. For example, there may be 5–7 metal interconnect layers and each of the layers have different process parameters. Furthermore, a tool may be processing several different products. The advantage having a multiple anode reactor on the tool (like the CFD reactor) is that unique anode currents and optimal performance may be specified for all the different recipes on all the different chambers on the tool.

A basic application of the optimizer is to aid in the initial dial-in process for all of the recipes that are going to be run on a tool in production. In this mode, recipes will be written and tested experimentally prior to production, using the optimizer as an aid to obtained uniformity specifications. In this picture of workpiece production, the optimizer is used during the set-up phase only, saving the process engineer much time in setting up the tool and each of the recipes. If seed-layers coming into the tool are identical and stable, the above picture is sufficient.

If the seed-layers are not consistent, then off-tool metrology or integrated metrology can be used to monitor the changes in the seed-layers and the optimizer can be used to modify the anode currents in the recipe to compensate for these variations.

ECD seed followed by bulk ECD: In the case of sequential plating steps, metrology before and after each plating step allows for recipe current adjustments with the optimizer to each process. In the case of ECD seed, the initial PVD or CVD layer of metal can be measured and adjusted for using the feed-forward feature of the optimizer. Note: In this process the resistance of the barrier layer under the seed layer can also have a large influence on the plating uniformity, if the resistance of this layer can be measured, then the optimizer can be used to compensate for this effect (it may take more than one iteration of the optimizer).

Dial-In Uniform Current Density Recipes: Using the optimizer and metrology the optimizer can be used to help dial in recipes that insure uniform current density during the feature filling step.

Table Look-Up: The optimal currents to plate uniformly on different thickness seed-layers (assuming the seed layers are substantially uniform) can be determined in advance, using the optimizer to find these currents. Then the currents can be pulled from a table, when the resistivity of the seed layer is measured. This may be quite useful for platen plating (solder) where the seed layer resistance is constant for the whole plating run.

It is envisioned that the optimizer may be used in one or more stages of widely-varying processes for processing semiconductor workpieces. It is further envisioned that the optimizer may operate completely separately from the processing tools performing such processes, with only some mechanism for the optimizer to pass control parameters to such processing tools. Indeed, the optimizer and processing tools may be operated under the control and/or ownership of different parties, and/or in different physical locations.

Numerous modifications may be made to the described optimizer without departing from the basic teachings thereof For example, although the present invention is described in the context of electrochemical processing of the microelectronic workpiece, the teachings herein can also be extended to other types of microelectronic workpiece processing, including various kinds of material deposition processes. For example, the optimizer may be used to control electrophoretic deposition of material, such as positive or negative electrophoretic photoresists or electrophoretic paints; chemical or physical vapor deposition; etc. In effect, the teachings herein can be extended to other microelectronic workpiece processing systems that have individually controlled processing elements that are responsive to control parameters and that have interdependent effects on a physical characteristic of the microelectronic workpiece that is processed using the elements. Such systems may employ sensitivity tables or matrices as set forth herein and use them in calculations with one or more input parameters sets to arrive at control parameter values that accurately result in the targeted physical characteristic of the microelectronic workpiece. Although the present invention has been described in substantial detail with reference to one or more specific embodiments, those of skill in the art will recognize that changes may be made thereto without departing from the scope and spirit of the invention as set forth herein.

We claim:

1. A method in a computing system for controlling an electroplating process having multiple steps in an electroplating chamber having a plurality of electrodes, comprising:

for each electrode, determining the net plating charge delivered through the electrode during a first plating cycle to plate a first workpiece by summing the plating charges delivered through the electrode in each step of the process;

comparing a plating profile achieved in plating the first workpiece to a target plating profile to identify deviations between the achieved plating profile and the target plating profile;

determining new net plating charges for each electrode selected to reduce the identified deviations in a second workpiece;

for each new plating charge, distributing the new net plating charge across the steps of the process;

using the distributed new net plating charges to determine a current for each electrode for each step of the process; and conducting a second plating cycle to plate a second workpiece, using the currents determined for each electrode for each step.

2. The method of claim 1 wherein the new net plating charges are distributed uniformly across all of the steps of the process.

3. The method of claim 1 wherein the new net plating charges are distributed across the steps of the process by distributing differences between the new net plating charge and the delivered net plating charge to a single step of the process.

4. The method of claim 1 wherein the distributing includes distributing the new net plating charges to each of two or more phases of a selected one of the steps of the process.

5. The method of claim 1, further comprising repeating the method to further reduce deviations between the achieved plating profile and the target plating profile.

6. The method of claim 1 wherein a sensitivity matrix is used to determine the new net plating charges.

7. The method of claim 1 wherein a different sensitivity matrix is used to determine a new net plating charge for each step of the process.

8. A computer-readable medium whose contents cause a computing system to perform a method for controlling an electroplating process having multiple steps in an electroplating chamber having a plurality of electrodes, the method comprising:

for each electrode, determining the net plating charge delivered through the electrode during a first plating cycle to plate a first workpiece by summing the plating charges delivered through the electrode in each step of the process;

comparing a plating profile achieved in plating the first workpiece to a target plating profile to identify deviations between the achieved plating profile and the target plating profile;

determining new net plating charges for each electrode selected to reduce the identified deviations in a second workpiece;

for each new plating charge, distributing the new net plating charge across the steps of the process;

using the distributed new net plating charges to determine a current for each electrode for each step of the process; and conducting a second plating cycle to plate a second workpiece, using the currents determined for each electrode for each step.

9. The computer-readable medium of claim 8 wherein the new net plating charges are distributed uniformly across all of the steps of the process.

10. The computer-readable medium of claim 8 wherein the new net plating charges are distributed across the steps of the process by distributing differences between the new net plating charge and the delivered net plating charge to a single step of the process.

11. The computer-readable medium of claim 8 wherein the distributing includes distributing the new net plating charges to each of two or more phases of a selected one of the steps of the process.

12. The computer-readable medium of claim 8, the method further comprising repeating the method to further reduce deviations between the achieved plating profile and the target plating profile.

13. The computer-readable medium of claim 8 wherein a sensitivity matrix is used to determine the new net plating charges.

14. The computer-readable medium of claim 8 wherein a different sensitivity matrix is used to determine a new net plating charge for each step of the process.

15. A method in a computing system for controlling an electroplating process in an electroplating chamber having a plurality of electrodes, comprising:

for each electrode, determining the net plating charge delivered through the electrode during a first plating cycle to plate a first workpiece;

comparing a plating profile achieved in plating the first workpiece to a target plating profile to identify deviations between the achieved plating profile and the target plating profile;

determining new net plating charges for each electrode selected to reduce the identified deviations in a second workpiece;

using the determined new net plating charges to determine a current for each electrode for each step of the process; and conducting a second plating cycle to plate a second workpiece, using the currents determined for each electrode.

16. The method of claim 15, further comprising repeating the method to further reduce deviations between the achieved plating profile and the target plating profile.

17. The method of claim 15 wherein a sensitivity matrix is used to determine the new net plating charges.

18. The method of claim 15 wherein a different sensitivity matrix is used to determine a new net plating charge for each step of the process.

19. A computer-readable medium whose contents cause a computing system to perform a method for controlling an electroplating process in an electroplating chamber having a plurality of electrodes, the method comprising:

for each electrode, determining the net plating charge delivered through the electrode during a first plating cycle to plate a first workpiece;

comparing a plating profile achieved in plating the first workpiece to a target plating profile to identify deviations between the achieved plating profile and the target plating profile;

determining new net plating charges for each electrode selected to reduce the identified deviations in a second workpiece;

using the determined new net plating charges to determine a current for each electrode for each step of the process; and conducting a second plating cycle to plate a second workpiece, using the currents determined for each electrode.

20. The computer-readable medium of claim 19, the method further comprising repeating the method to further reduce deviations between the achieved plating profile and the target plating profile.

21. The computer-readable medium of claim 19 wherein a sensitivity matrix is used to determine the new net plating charges.

22. The computer-readable medium of claim 19 wherein a different sensitivity matrix is used to determine a new net plating charge for each step of the process.

* * * * *